US010041183B2

(12) United States Patent
Arvin et al.

(10) Patent No.: US 10,041,183 B2
(45) Date of Patent: Aug. 7, 2018

(54) ELECTRODEPOSITION SYSTEMS AND METHODS THAT MINIMIZE ANODE AND/OR PLATING SOLUTION DEGRADATION

(71) Applicant: GlobalFoundries Inc., Grand Cayman (KY)

(72) Inventors: Charles L. Arvin, Poughkeepsie, NY (US); Harry D. Cox, Rifton, NY (US); Eric D. Perfecto, Poughkeepsie, NY (US)

(73) Assignee: GLOBALFOUNDRIES INC., Grand Cayman (KY)

( * ) Notice: Subject to any disclaimer, the term of this patent is extended or adjusted under 35 U.S.C. 154(b) by 0 days.

(21) Appl. No.: 15/482,938

(22) Filed: Apr. 10, 2017

(65) Prior Publication Data

US 2017/0211199 A1 Jul. 27, 2017

Related U.S. Application Data

(62) Division of application No. 14/284,932, filed on May 22, 2014, now Pat. No. 9,689,084.

(51) Int. Cl.

| | |
|---|---|
| ***C25D 21/12*** | (2006.01) |
| ***C25D 5/18*** | (2006.01) |
| ***C25D 17/10*** | (2006.01) |

(52) U.S. Cl.

CPC ..... *C25D 5/18* (2013.01); *C25D 17/10* (2013.01); *C25D 21/12* (2013.01)

(58) Field of Classification Search

CPC ..... C25D 21/12

See application file for complete search history.

(56) References Cited

U.S. PATENT DOCUMENTS

| | | | | |
|---|---|---|---|---|
| 4,666,567 A | | 5/1987 | Loch | |
| 5,441,620 A | * | 8/1995 | Nishimura | C25D 17/00 204/230.5 |

(Continued)

FOREIGN PATENT DOCUMENTS

| | | | | |
|---|---|---|---|---|
| DE | 3116789 | | 11/1982 | |
| GB | 2026031 A | * | 1/1980 | C25B 15/02 |

(Continued)

OTHER PUBLICATIONS

Office Action Communication, U.S. Appl. No. 14/284,932, dated Oct. 14, 2016, pp. 1-6.

(Continued)

*Primary Examiner* — Bryan D. Ripa

(74) *Attorney, Agent, or Firm* — Gibb & Riley, LLC; Yuanmin Cai, Esq.

(57) ABSTRACT

Disclosed are electrodeposition systems and methods wherein at least three electrodes are placed in a container containing a plating solution. The electrodes are connected to a polarity-switching unit and include a first electrode, a second electrode and a third electrode. The polarity-switching unit establishes a constant polarity state between the first and second electrodes in the solution during an active plating mode, wherein the first electrode has a negative polarity and the second electrode has a positive polarity, thereby allowing a plated layer to form on a workpiece at the first electrode. The polarity-switching unit further establishes an oscillating polarity state between the second and third electrodes during a non-plating mode (i.e., when the first electrode is removed from the plating solution), wherein the second electrode and the third electrode have opposite polarities that switch at regular, relatively fast, intervals, thereby limiting degradation of the second electrode and/or the plating solution.

19 Claims, 14 Drawing Sheets

(56) References Cited

U.S. PATENT DOCUMENTS

| | | | | |
|---|---|---|---|---|
| 6,344,124 | B1 * | 2/2002 | Bhatnagar | C25D 5/10 204/225 |
| 7,566,386 | B2 | 7/2009 | Wilson et al. | |
| 8,329,006 | B2 | 12/2012 | Gebhart et al. | |
| 2001/0054557 | A1 | 12/2001 | Taylor et al. | |
| 2003/0044303 | A1 | 3/2003 | Chen et al. | |
| 2006/0032758 | A1 * | 2/2006 | Klocke | C23C 18/1632 205/219 |
| 2006/0086609 | A1 | 4/2006 | Chang et al. | |
| 2010/0221571 | A1 * | 9/2010 | Battisti | C25D 5/18 428/615 |
| 2012/0138471 | A1 | 6/2012 | Mayer et al. | |
| 2012/0298504 | A1 | 11/2012 | Guamaccia et al. | |
| 2012/0325667 | A1 | 12/2012 | Arvin et al. | |
| 2013/0001198 | A1 | 1/2013 | Arvin et al. | |
| 2013/0062209 | A1 | 3/2013 | Arvin et al. | |
| 2013/0334052 | A1 | 12/2013 | Chua et al. | |
| 2014/0262797 | A1 * | 9/2014 | Chang | C25D 5/02 205/95 |
| 2015/0337451 | A1 * | 11/2015 | Arvin | C25D 21/12 205/96 |
| 2016/0024683 | A1 * | 1/2016 | Dingwerth | C25D 17/002 205/246 |

FOREIGN PATENT DOCUMENTS

| | | | |
|---|---|---|---|
| JP | 2004-162177 | 6/2004 | |
| JP | 5238261 | 4/2013 | |
| SU | DE 3116789 A1 * | 11/1982 | C25D 1/00 |

OTHER PUBLICATIONS

Office Action Communication, U.S. Appl. No. 14/284,932, dated Nov. 9, 2016, pp. 1-16.
Office Action Communication, U.S. Appl. No. 14/284,932, dated Feb. 2, 2017, pp. 1-15.
Notice of Allowance, U.S. Appl. No. 14/284,932, dated Mar. 27, 2017, pp. 1-5.
Machine Translation English Abstract of DE 3116789 A1.

* cited by examiner

ELECTRODEPOSITION SYSTEMS AND METHODS THAT MINIMIZE ANODE AND/OR PLATING SOLUTION DEGRADATION

CROSS-REFERENCE TO RELATED APPLICATIONS

The present invention claims the benefit under 35 U.S.C. § 120 as a divisional of U.S. patent application Ser. No. 14/284,932 filed on May 22, 2014, now issued as U.S. Pat. No. 9,689,084 on Jun. 27, 2017, the entire teachings of which are incorporated herein by reference.

BACKGROUND

The present invention relates to electrodeposition and, more particularly, to electrodeposition systems and methods that minimize anode and/or plating solution degradation during idle periods (i.e., non-plating periods).

Generally, electrodeposition (also referred to herein as electroplating) is a process in which plating material(s) such as one or more different metals are deposited onto a workpiece. Specifically, during electrodeposition, a first electrode with a workpiece to be plated and at least one second electrode are placed into a plating solution (i.e., a plating bath) within a plating container. Then, an electrical circuit is created by connecting a negative terminal of a power supply to the first electrode to form a cathode and further connecting a positive terminal of the power supply to the second electrode(s) so as to form anode(s). When the electric circuit is created, electric current flows from the anode(s) to the cathode by means of ion transport through the plating solution and electron transfer at the electrodes occurs such that each of the plating materials, which is/are dissolved in the plating solution as stabilized metal species (i.e., as metal ions), takes up electrons at the cathode, thereby causing a layer of metal or a layer of a metal alloy (e.g., depending upon whether a single or multiple metal species are used) to deposit on the cathode. The metal specie(s) in the plating solution can be replenished by the anode(s), if/when the anode(s) are soluble (i.e., if/when the anode(s) comprise soluble metal(s)) and the electric current causes the soluble metal(s) to dissolve in the plating solution). Additionally or alternatively, the metal specie(s) can be added directly to the plating solution.

Unfortunately, immediately following electrodeposition and, particularly, during an idle period after the first electrode has been disconnected from the power source and removed from the plating solution, any charged surface of the anode(s) can potentially cause unwanted reactions that result in anode degradation and/or plating solution degradation. Therefore, there is a need in the art for electrodeposition systems and methods that minimize anode and/or plating solution degradation during idle periods (i.e., non-plating periods).

SUMMARY

In view of the foregoing, disclosed herein are electrodeposition systems and methods that minimize anode and/or plating solution degradation during idle periods (i.e., during non-plating periods). Specifically, in the electrodeposition systems and methods disclosed herein at least three electrodes are placed in a container containing a plating solution. These electrodes are each electrically connected to a polarity-switching unit and include at least a first electrode, a second electrode and a third electrode. The polarity-switching unit establishes a constant polarity state between the first electrode and the second electrode in the plating solution during an active plating mode. In this constant polarity state, the first electrode has a negative polarity and the second electrode has a positive polarity, thereby allowing a plated layer to form on a workpiece at the first electrode. The polarity-switching unit further establishes an oscillating polarity state between the second electrode and the third electrode during a non-plating mode (i.e., when the first electrode with the workpiece is removed from the plating solution). In this oscillating polarity state, the second electrode and the third electrode have opposite polarities that switch at regular intervals, thereby limiting (e.g., preventing) electron transfer at the surfaces of the second electrode and third electrode so as to limit (e.g., prevent) degradation of those electrodes and the second electrode in particular and/or so as to limit degradation of the plating solution.

More particularly, disclosed herein are electrodeposition systems. Each system can comprise a container containing a plating solution and at least three electrodes. The three electrodes can comprise a first electrode removeably placed in the container with and electrically connected to a workpiece to be plated; a second electrode in the container; and, a third electrode in the container.

Each system can further comprise a polarity-switching unit. The polarity-switching unit can be electrically connected to the first electrode, the second electrode and the third electrode and can be selectively operated in either an active plating mode or a non-plating mode (i.e., when the first electrode with the workpiece is removed from the plating solution). In the active plating mode, the polarity-switching unit can establish a constant polarity state between the first electrode and the second electrode in the plating solution such that the first electrode has a negative polarity (i.e., is a cathode) and the second electrode has a positive polarity (i.e., is an anode), thereby allowing metal ions dissolved in the plating solution to form a plated layer of a metal or metal alloy on the workpiece. In the non-plating mode, the first electrode with the workpiece is removed from the plating solution, as mentioned above, and the polarity-switching unit can establish an oscillating polarity state between the second electrode and the third electrode such that the second electrode and the third electrode have opposite polarities and such that the opposite polarities switch at regular intervals, thereby limiting (e.g., preventing) electron transfer at the surfaces of the second electrode and third electrode so as to limit (e.g., prevent) degradation of those electrodes and the second electrode in particular and/or so as to limit degradation of the plating solution.

As discussed in greater detail in the detailed description of this specification, the second electrode (i.e., the anode during the active plating mode) can be soluble, insoluble or corrosion-resistant. Furthermore, the third electrode can be either corrosion-resistant or simply insoluble, depending upon the specific configuration of the electrodeposition system. In any case such electrodeposition systems can be used to form, on a workpiece, a plated layer of a metal or metal alloy comprising one or more of a variety of different metals.

One particular electrodeposition system disclosed herein can comprise a tin-silver (SnAg) electrodeposition system. This SnAg electrodeposition system can comprise a container containing a methyl sulfonic acid (MSA)-based plating solution and at least three electrodes. The three electrodes can comprise a first electrode removeably placed in the container with and electrically connected to a workpiece to be plated; a second electrode in the container; and, a third electrode in the container.

The SnAg electrodeposition system can further comprise a polarity-switching unit. The polarity-switching unit can be electrically connected to the first electrode, the second electrode and the third electrode and can be selectively operated in an active plating mode or a non-plating mode (i.e., when the first electrode with the workpiece is removed from the MSA-based plating solution). In the active plating mode, the polarity-switching unit can establish a constant polarity state between the first electrode and the second electrode in the MSA-based plating solution such that the first electrode has a negative polarity and the second electrode has a positive polarity, thereby allowing tin ions ($Sn^{2+}$ ions) and silver ions ($Ag^{+}$ ions) dissolved in the MSA-based plating solution to form a SnAg plated layer on the workpiece. In the non-plating mode, the first electrode with the workpiece is removed from the plating solution, as mentioned above, and the polarity-switching unit can establish an oscillating polarity state between the second electrode and the third electrode such that the second electrode and the third electrode have opposite polarities and such that the opposite polarities switch at regular intervals. As in the more general systems described above, in this case the oscillating polarity state limits (e.g., prevents) electron transfer at the surfaces of the second electrode and third electrode so as to limit (e.g., prevent) degradation of those electrodes and the second electrode in particular and/or so as to limit degradation of the MSA-based plating solution.

Also disclosed herein are electrodeposition methods. These methods can comprise providing a container containing a plating solution and at least three electrodes. The three electrodes can comprise a first electrode removeably placed in the container with and electrically connected to a workpiece to be plated; a second electrode; and, a third electrode.

The method can further comprise establishing, during an active plating mode, a constant polarity state between the first electrode and the second electrode in the plating solution such that the first electrode has a negative polarity (i.e., is a cathode) and the second electrode has a positive polarity (i.e., is an anode), thereby allowing metal ions dissolved in the plating solution to form a plated layer of a metal or metal alloy on the workpiece. The method can further comprise establishing, during a non-plating mode (i.e., when the first electrode with the workpiece is removed from the plating solution), an oscillating polarity state between the second electrode and the third electrode such that the second electrode and the third electrode have opposite polarities and such that the opposite polarities switch at regular intervals, thereby limiting (e.g., preventing) electron transfer at the surfaces of the second electrode and third electrode so as to limit (e.g., prevent) degradation of those electrodes and the second electrode in particular and/or so as to limit degradation of the plating solution.

As discussed in greater detail in the detailed description of this specification, the second electrode (i.e., the anode during the active plating mode) can be soluble, insoluble or corrosion-resistant. Furthermore, the third electrode can be either corrosion-resistant or simply insoluble, depending upon the specific configuration of the electrodeposition system used in the performance of the method. In any case such electrodeposition methods can be used to form a plated layer comprising one or more of a variety of different metals on a workpiece.

One particular electrodeposition method disclosed herein can comprise a tin-silver (SnAg) electrodeposition method. This SnAg electrodeposition method can comprise providing a container containing a methyl sulfonic acid (MSA)-based plating solution and at least three electrodes. The three electrodes can comprise a first electrode removeably placed in the container with and electrically connected to a workpiece to be plated; a second electrode; and, a third electrode.

The SnAg electrodeposition method can further comprise establishing, during an active plating mode, a constant polarity state between the first electrode and the second electrode in the MSA-based plating solution such that the first electrode has a negative polarity (i.e., is a cathode) and the second electrode has a positive polarity (i.e., is an anode), thereby allowing tin ions ($Sn^{2+}$ ions) and silver ions ($Ag^{+}$ ions) dissolved in the MSA-based plating solution to form a SnAg plated layer on the workpiece. The method can further comprise establishing, during a non-plating mode (i.e., when the first electrode with the workpiece is removed from the SnAg plating solution), an oscillating polarity state between the second electrode and the third electrode such that the second electrode and the third electrode have opposite polarities and such that the opposite polarities switch at regular intervals. As in the more general methods described above, in this case the oscillating polarity state limits (e.g., prevents) electron transfer at the surfaces of the second electrode and third electrode so as to limit (e.g., prevent) degradation of those electrodes and the second electrode in particular and/or so as to limit degradation of the MSA-based plating solution.

BRIEF DESCRIPTION OF THE SEVERAL VIEWS OF THE DRAWINGS

The embodiments herein will be better understood from the following detailed description with reference to the drawings, which are not necessarily drawn to scale and in which.

DETAILED DESCRIPTION

Figure 1:
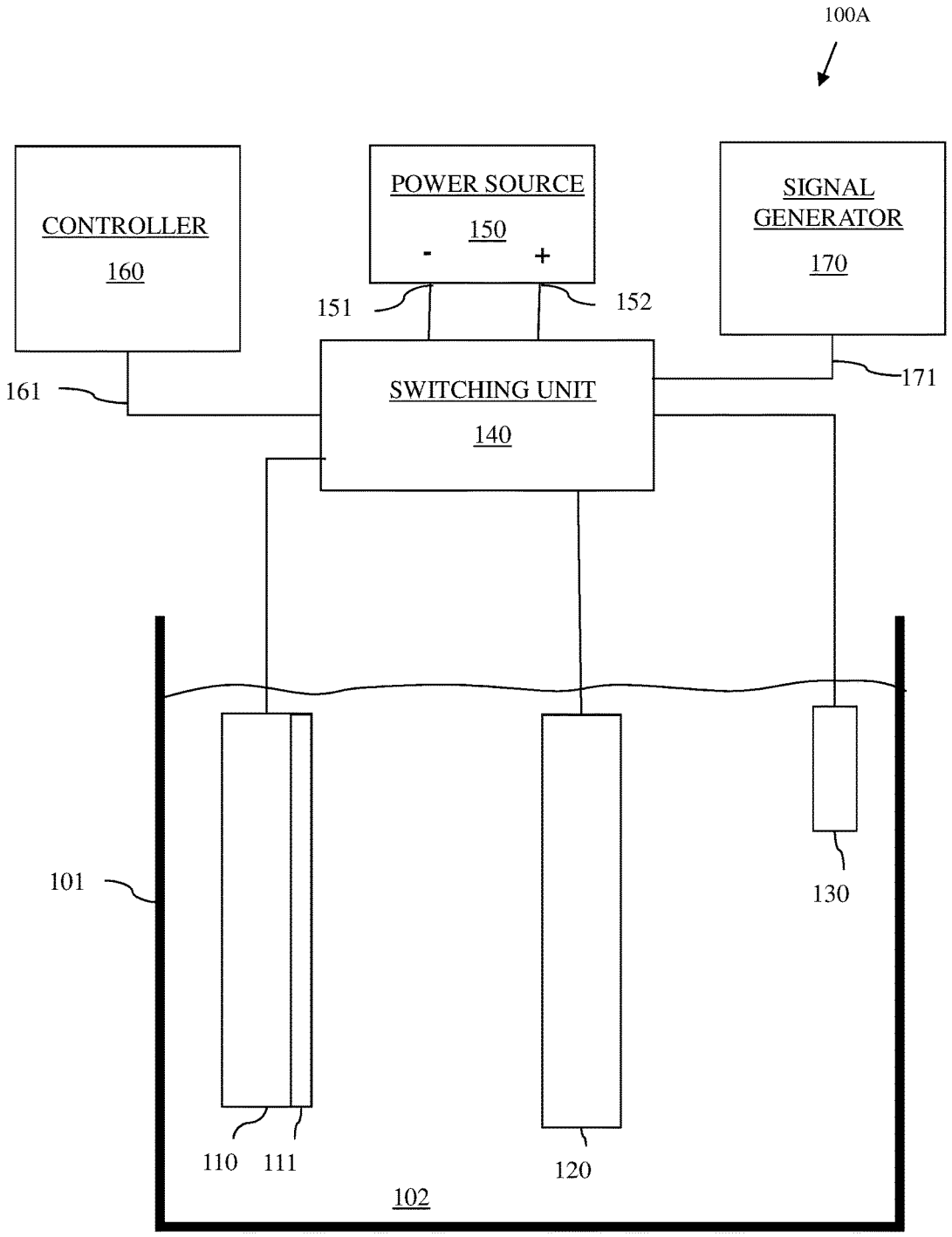
FIG. 1 is a schematic diagram illustrating an electrodeposition system.

As mentioned above, electrodeposition (also referred to herein as electroplating) is a process in which plating material(s) and, particularly, one or more different metals are deposited onto a workpiece. Specifically, during electrodeposition, a first electrode with a workpiece (i.e., an object, an article, etc.) to be plated and at least one second electrode are placed into a plating solution (i.e., a plating bath) within a plating container. Then, an electrical circuit is created by connecting a negative terminal of a power supply to the first electrode to form a cathode and further connecting a positive terminal of the power supply to the second electrode(s) so as to form anode(s). When the electric circuit is created, electric current flows through the plating solution from the anode(s) to the cathode by means of ion transport through the plating solution and electron transfer at the electrodes such that each of the plating materials, which is/are dissolved in the plating solution as stabilized metal species (i.e., as metal ions), takes up electrons at the cathode, thereby causing a layer of metal or a layer of a metal alloy (e.g., depending upon whether a single or multiple metal species are used) to deposit on the cathode. The metal specie(s) in the plating solution can be replenished by the anode(s), if/when the anode(s) are soluble (i.e., if/when the anode(s) comprise soluble metal(s)) and the electric current causes the soluble metal(s) to dissolve in the plating solution). Additionally or alternatively, the metal specie(s) can be added directly to the plating solution.

Unfortunately, immediately following electrodeposition and, particularly, during an idle period after the first electrode has been disconnected from the power source and removed from the plating solution, any charged surface of the anode(s) can potentially cause unwanted reactions that result in anode degradation and/or plating solution degradation. Degradation of the anode and/or the plating solution can lead to non-uniform plating.

For example, electrodeposition is often used to deposit tin-silver (SnAg) solder for controlled collapsed chip connections (i.e., C4 connections) on integrated circuit chips; however, during idle time periods, unwanted reactions can result in degradation of any soluble or insoluble anode(s) used and/or can result in degradation of the plating solution, which can in turn lead to non-uniform plating and, particularly, skip plating. Those skilled in the art will recognize that the term skip plating refers to C4 solder plating that is non-uniform such that the either no solder or a relatively low volume of solder is deposited for some of the C4 connections on an integrated circuit chip.

Specifically, one technique for electrodeposition of SnAg solder uses a methyl sulfonic acid (MSA)-based plating solution, wherein a soluble tin (Sn) anode is used and this soluble Sn anode replenishes the tin ions ($Sn^{2+}$ ions) in the MSA-based plating solution. However, during an idle period, after the first electrode with the workpiece (i.e., the object to be plated) has been disconnected from the power source and removed from the plating solution, the less noble Sn anode can cause the Ag+ ions in the plating solution to plate onto the anode (i.e., can cause unwanted removal of the Ag+ ions from the plating solution), thereby degrading the composition of the MSA-based plating solution, which will lead to low Ag composition and non-uniform deposition of the deposited SnAg alloy.

Another technique for electrodeposition of SnAg solder also uses a methyl sulfonic acid (MSA)-based plating solution, wherein a non-soluble anode (e.g., a platinum (Pt) catalyst-coated titanium (Ti) anode) is used and wherein tin ions ($Sn^{2+}$ ions) are replenished in the plating solution by the addition, to the MSA-based plating solution, of a tin (Sn) salt or a tin (Sn) concentrate (which comprises Sn salt previously dissolved in water or an MSA solution). While this technique avoids silver (Ag) plating on the anode, the use of Sn salts and, particularly, Sn concentrates is relatively expensive as compared to a soluble Sn anode, due to the limited commercial availability of ultra low alpha Sn concentrate. Additionally, during continuous use of the non-soluble anode the Pt coating is typically eroded with time, exposing the titanium (Ti) surface below. This titanium oxide ($TiO_2$) is soluble in the MSA-based plating solution when it is not polarized, which allows Sn to deposit on it during idle times (i.e., during non-plating periods). In this case, the positive charge on the insoluble anode can cause titanium ions ($Ti^{4+}$ ions) to dissolve into the MSA-based plating solution and can further cause plating of tin ions ($Sn^{2+}$ ions) from the MSA-based plating solution onto the anode and, particularly, can cause the conversion of the $TiO_2$ to tin oxide ($SnO_2$), thereby forming an $SnO_2$/Pt catalyst-coated Ti anode, which can readily degrade organics in the MSA-based plating solution and lead to skip plating.

In view of the foregoing, disclosed herein are electrodeposition systems and methods that minimize anode and/or plating solution degradation during idle periods (i.e., non-plating periods). Specifically, in the electrodeposition systems and methods disclosed herein at least three electrodes are placed in a container containing a plating solution. These electrodes are each electrically connected to a polarity-switching unit and include at least a first electrode, a second electrode and a third electrode. The polarity-switching unit establishes a constant polarity state between the first electrode and the second electrode in the plating solution during an active plating mode. In this constant polarity state, the first electrode has a negative polarity and the second electrode has a positive polarity, thereby allowing a plated layer to form on a workpiece at the first electrode. The polarity-switching unit further establishes an oscillating polarity state between the second electrode and the third electrode during a non-plating mode (i.e., when the first electrode with the workpiece is removed from the plating solution). In this oscillating polarity state, the second electrode and the third electrode have opposite polarities that switch at regular intervals, thereby limiting (e.g., preventing) electron transfer at the surfaces of the second electrode and third electrode so as to limit (e.g., prevent) degradation of those electrodes and the second electrode in particular and/or so as to limit degradation of the plating solution.

Figure 2:
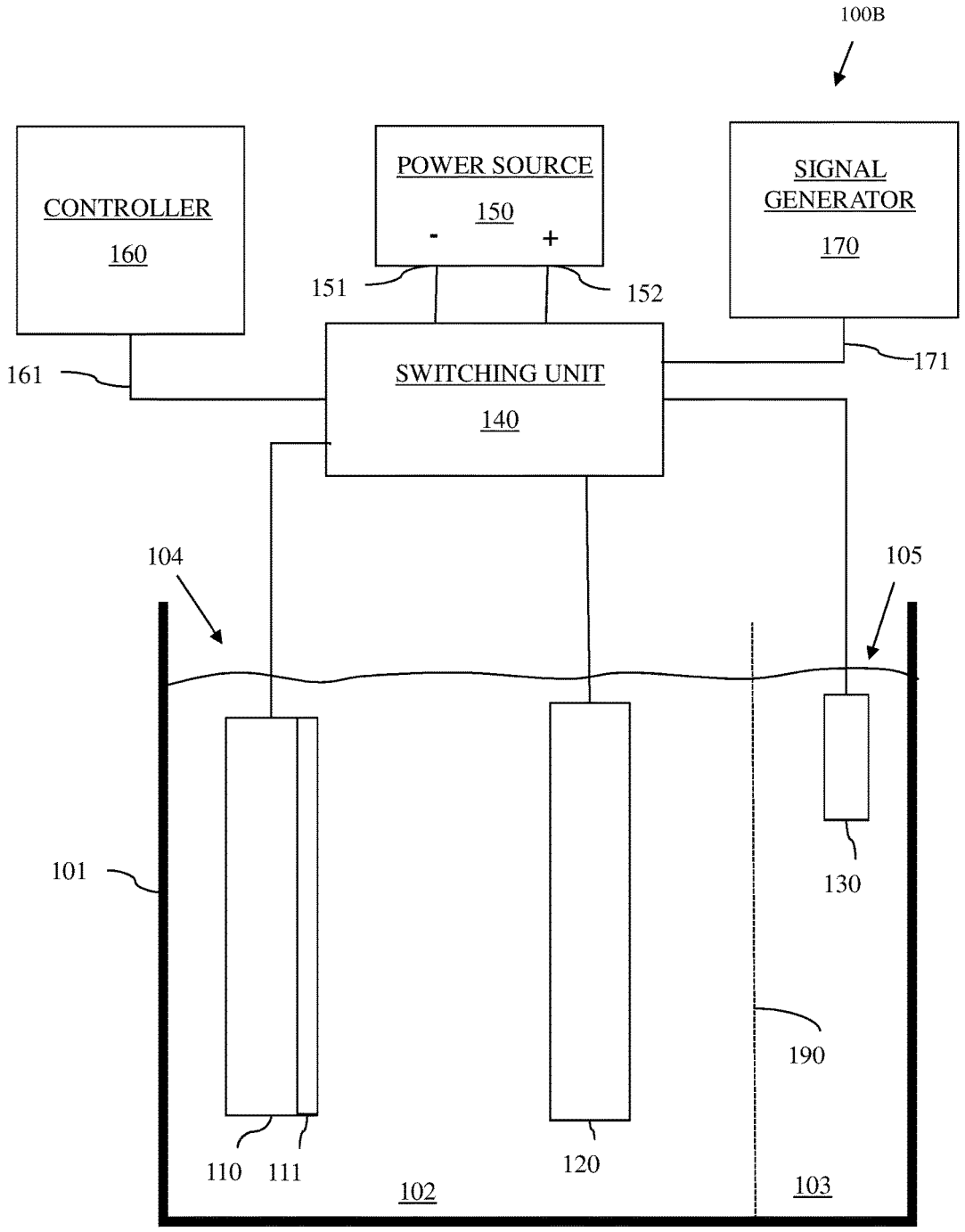
FIG. 2 is a schematic diagram illustrating another electrodeposition system.
Figure 3:
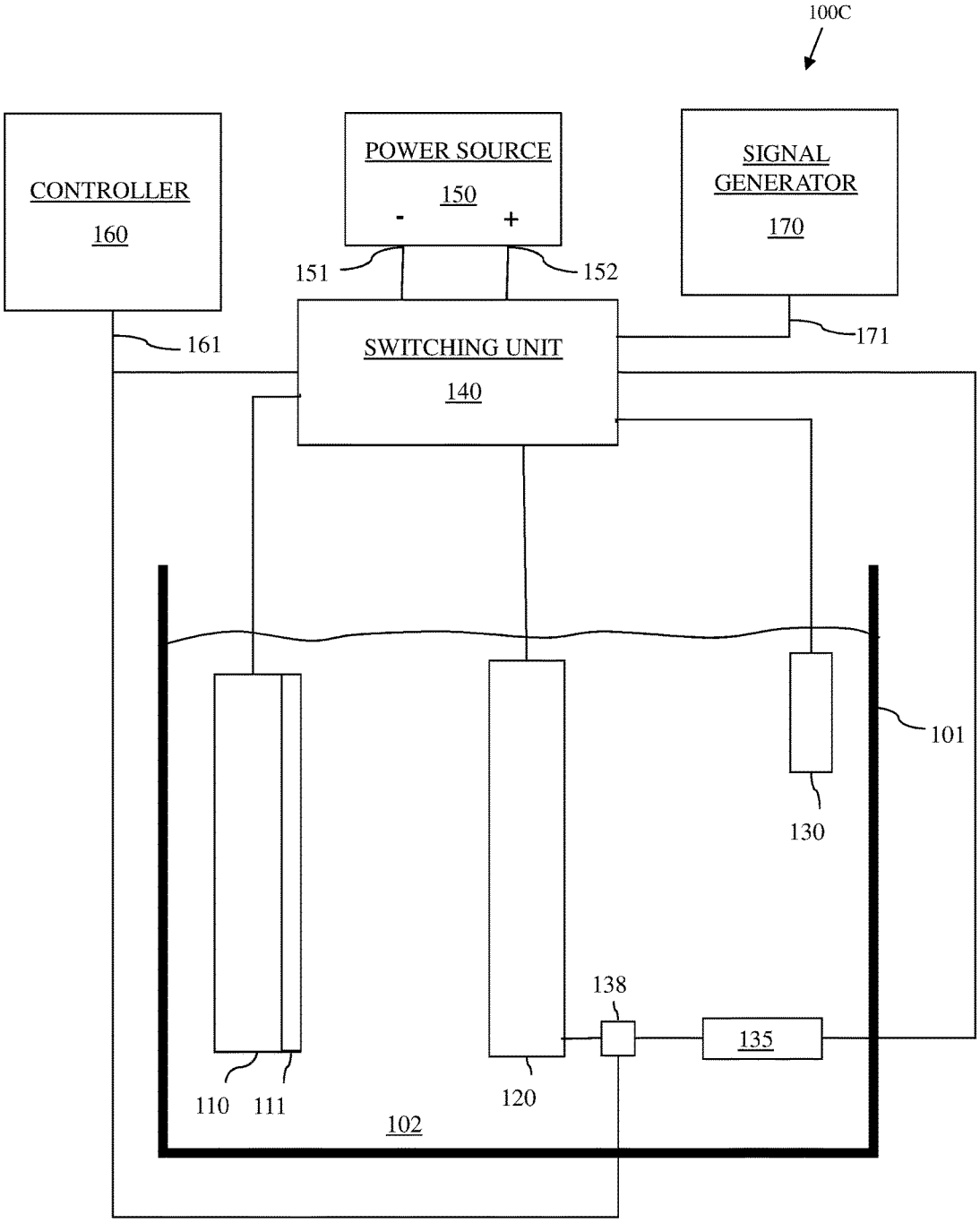
FIG. 3 is a schematic diagram illustrating yet another electrodeposition system.

More particularly, referring to FIGS. 1-3, disclosed herein are electrodeposition systems 100A, 100B, and 100C, respectively. For purposes of illustration, the electrodeposition systems 100A, 100B, 100C are described below for use in depositing a plated layer of tin-silver (SnAg). Such tin-silver plate is typically used as solder for controlled collapsed chip connections (i.e., C4 connections) on integrated circuit chips. However, it should be understood that these electrodeposition systems 100A, 100B, 100C could, alternatively, be used to deposit any other type of metal or metal alloy plated layer. That is, these electrodeposition systems 100A, 100B, 100C could alternatively be used to deposit a plated layer comprising one or more of a variety of different metals including, but are not limited to, tin (Sn), silver (Ag), nickel (Ni), cobalt (Co), lead (Pb), copper (Cu), palladium (Pd), gold (Au) and their various alloys.

In any case, each electrodeposition system 100A, 100C, 100B can comprise a container 101 containing a plating solution 102. For purposes of this disclosure, a plating solution comprises at least a solvent (e.g., water) and a substance (e.g., an acid or base) that is dissolved in the solvent and that provides ionic conductivity. Optionally, a plating solution can comprise one or more organic additive(s) (also referred to herein as organics), such as complexers, charge carriers, levelers, brighteners and/or wetters, dissolved in the solvent. The plating solution can also comprise one or more metal species dissolved in the solvent. The metal specie(s) can be dissolved in the plating solution 102 from metal salt(s) or from metal concentrate(s) (which are metal salt(s) previously dissolved in the same solvent used in the plating solution) and/or from soluble anode(s) used during an active plating mode, as discussed in greater detail below. In SnAg electrodeposition, for example, this plating solution 102 can comprise a methyl sulfonic acid (MSA)-based plating solution comprising a solvent and, particularly, water and methyl sulfonic acid (MSA) that is dissolved in the water and that provides ionic conductivity. Alternatively, this plating solution 102 can comprise a phosphonate-based plating solution, a pyrophosphate-based plating solution or any other suitable plating solution. In any case, the plating solution 102 can optionally further comprise one or more organic additive(s), such as complexers, charge carriers, levelers, brighteners and/or wetters, dissolved in the water. The plating solution 102 can also comprise tin ions ($Sn^{2+}$ ions) and silver (Ag+ ions) dissolved in the water. The tin ions ($Sn^{2+}$ ions) can be dissolved in the water from a tin (Sn) salt or from a tin (Sn) concentrate and/or can be dissolved in the water, during an active plating mode, from a soluble tin (Sn) anode (e.g., if such an anode is used (see detailed discussion below regarding anode composition)). The silver ions (Ag+ ions) can be dissolved in the water from a silver (Ag) salt or a silver (Ag) concentrate (which comprises Ag salt previously dissolved in water or an MSA solution).

Each electrodeposition system 100A, 100B, 100C can further comprise at least three electrodes. The three electrodes can comprise a first electrode 110 removeably placed in the container 101 with and electrically connected to a workpiece 111 (i.e., an object, an article, etc.) to be plated; a second electrode 120 in the container 101; and, a third electrode 130 in the container 101.

Each electrodeposition system 100A, 100B, 100C can further comprise a polarity-switching unit 140. The polarity-switching unit 140 can be electrically connected to the first electrode 110, the second electrode 120 and the third electrode 130. The polarity-switching unit 140 can further be selectively operated in an active plating mode (i.e., when one or more metal species are deposited as a plated layer on the workpiece 111) or a non-plating mode (i.e., when the first electrode 110 with the workpiece 111 is removed from the plating solution).

Figure 4:
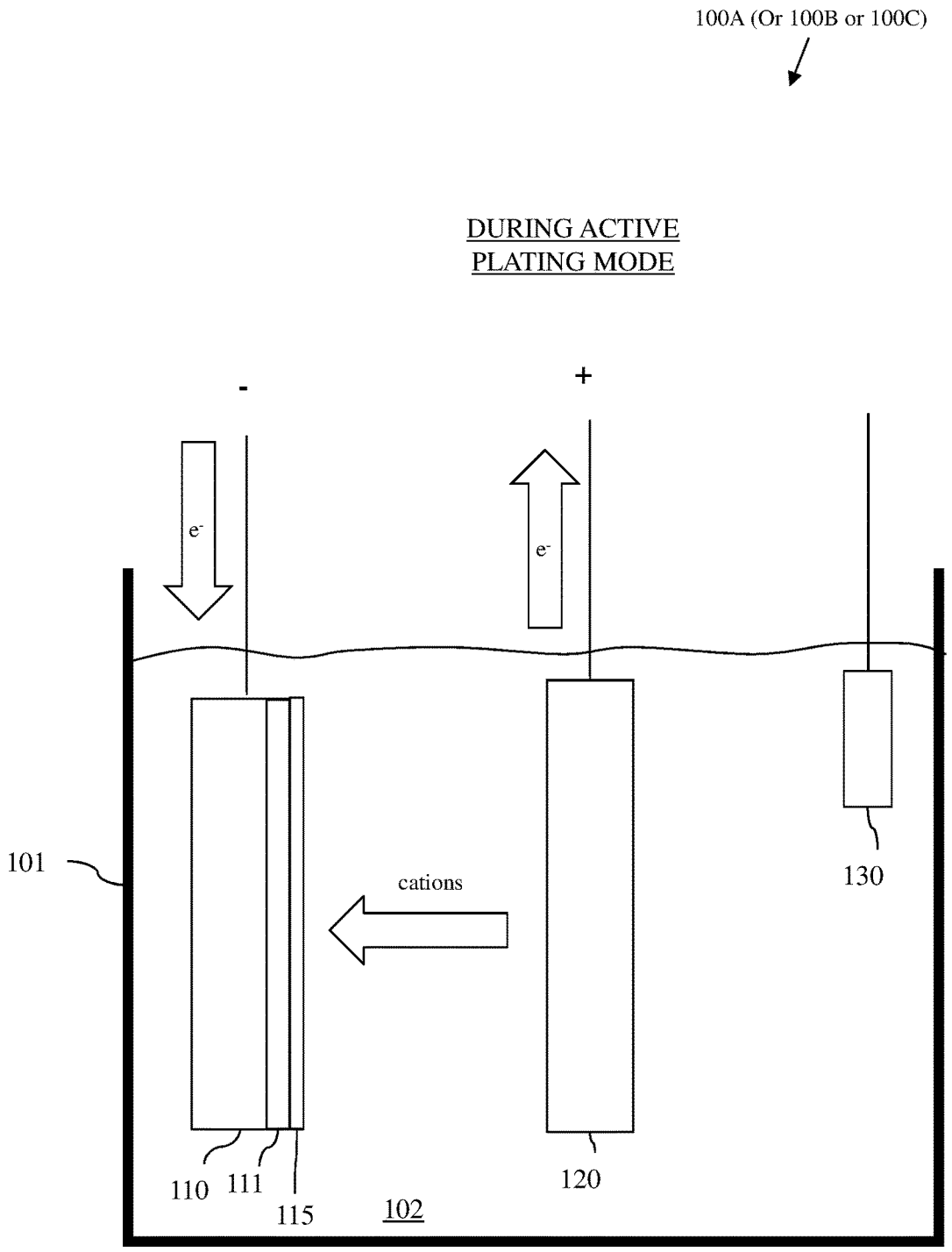
FIG. 4 is a schematic diagram illustrating operation of the disclosed electrodeposition systems in an active plating mode.

In the active plating mode, the polarity-switching unit 140 can establish (i.e., can be adapted to establish, can be configured to establish, etc.) a constant polarity state between the first electrode 110 and the second electrode 120 in the plating solution 102. In this constant polarity state, the first electrode 110 has a negative polarity (i.e., is a cathode) and the second electrode 120 has a positive polarity (i.e., is an anode), thereby allowing the metal specie(s) (e.g., $Sn^{2+}$ ions and $Ag^{+}$ ions) dissolved in the plating solution 102 to form a plated layer 115 of a metal or metal alloy (e.g., a SnAg plated layer) on the workpiece 111 (as shown in FIG. 4). In the non-plating mode, the first electrode 110 with the workpiece 111 is removed from the plating solution 102, as mentioned above, and the polarity-switching unit 140 can establish (i.e., can be adapted to establish, can be configured to establish, etc.) an oscillating polarity state between the second electrode 120 and the third electrode 130. In this oscillating polarity state, the second electrode 120, which functioned as the anode during active plating, and the third electrode 130 have opposite polarities and the opposite polarities switch at regular, relatively fast, intervals, thereby limiting (e.g., preventing) electron transfer at the plating solution exposed surfaces of the second electrode 120 (and, if applicable, the third electrode 130) so as to limit (e.g., prevent) degradation of those electrodes 120, 130 and the second electrode 120 in particular and/or so as to limit degradation of the plating solution 102.

To further explain this technique, it should be noted that the oscillating polarity state between the second electrode 120 and third electrode 130 takes advantage of the time required for an electrolytic double layer to establish itself on the surfaces of either of the electrodes 120 and 130. If the polarities of the electrodes 120 and 130 are switched fast enough (i.e., if the current direction is switched fast enough), for a given voltage, there will not be enough time for an electrolytic double layer to form on either of the electrodes 120 and 130. By preventing formation of this electrolytic double layer, electron transfer and the typical corrosion processes are prevented.

It should be noted that, in the active plating mode, the third electrode 130 can remain unpolarized (e.g., as described in detail below with regard to the electrodeposition systems 100A and 100B of FIGS. 1 and 2). Alternatively, in the active plating mode, an oscillating polarity state can be established between the third electrode 130 and a fourth electrode 135 (e.g., as described in detail below with regard to the electrodepostion system 100C of FIG. 3).

More specifically, each of the electrodeposition systems 100A, 100B, 100C can further comprise a power source 150, a controller 160, and a signal generator 170.

The power source 150 can comprise a negative terminal 151 and a positive terminal 152. The negative terminal 151 and the positive terminal 152 can each be electrically connected to the polarity-switching unit 140. The power source 150 can operate (i.e., can be adapted to operate, can be configured to operate, etc.) in a constant voltage mode. The potential difference measured in volts (V) between the negative terminal 151 and the positive terminal 152 can be set at a specific potential difference that is predetermined to optimize plating of the specific metal specie(s) used to form the plated layer 115 on the workpiece 111. In SnAg electrodeposition, for example, the potential difference required for tin ions ($Sn^{2+}$ ions) to dissolve in the MSA-based plating solution from a soluble Sn anode (if used) and for $Sn^{2+}$ ions and Ag+ ions to plate as a SnAg plated layer 115 on a workpiece 111 is at least 0.9 volts and the optimal potential difference (e.g., to ensure uniform plating) is between 1 and 5 volts.

The controller 160 can also be electrically connected to the polarity-switching unit 140 and can, for example, comprise a computer system such as that described in detail below and illustrated in FIG. 11. The controller 160 can generate (i.e., can be adapted to generate, can be configured to generate, can execute a program of instructions stored in memory to generate, etc.) an operating mode select signal 161 that selectively operates the polarity-switching unit 140 in either the active plating mode, as described above, or the non-plating mode, as described above. The operating mode select signal 161 can be generated by the controller 160, based on user input. Alternatively, the operating mode select signal 161 can be generated by the controller 160 automatically based on sensor or other inputs indicating whether the first electrode 110 is within the plating solution 102 in the container 101 or has been removed from the plating solution 102 (e.g., following plating). In any case, the operating mode select signal 161 can have a first value indicating the active plating mode and a second value, which is different from the first value, indicating the non-plating mode.

The signal generator 170 can generate (i.e., can be adapted to generate, can be configured to generate, can execute a program of instructions stored in memory to generate, etc.) a polarity-switching signal 171 with a specific frequency that defines the regular intervals at which the opposite polarities on the second electrode 120 and third electrode 130 will switch during the non-plating mode. This specific frequency can be predetermined so that the polarity-switching is fast enough to ensure that electron transfer at the surfaces of the second electrode 120 and third electrode 130 is limited (e.g., prevented) and, thereby to ensure the plating on or corrosion of those electrodes is also limited (e.g., prevented). That is, the frequency should be such that, for a given voltage, there will not be enough time for an electrolytic double layer to form on either of the electrodes 120 and 130. By preventing formation of this electrolytic double layer, electron transfer and the typical corrosion processes are prevented. This frequency will vary (e.g., from approximately 1 kHz up 1 MHz or even up to a GHz) depending upon the size of the applications and the composition of the plating solution 102, the metal specie(s) being plated, etc. In SnAg electrodeposition, for example, the required frequency to limit electron transfer at the second electrode 120 and third electrode 130 is at least 0.5 kHz and the optimal frequency (e.g., to prevent electron transfer) is between 1 kHz and 10 kHz.

It should be understood that, since the nature of the corrosion of electrodes in a plating solution is dependent upon the composition of those electrodes and the composition of the plating solution used, the specifications (e.g., potential and switching frequency) used during the non-plating mode to ensure that plating on or corrosion of the electrodes is limited can be determined using a systematic approach. For example, the potential needed to suppress corrosion of a specific metal of an electrode in a specific plating solution can be determined through the use of a Tafel plot of the specific metal within the specific plating solution relative to a reference electrode. The required frequency needed to limit electron transfer can further be determined by using two electrodes of the same given metal. The two electrodes can be polarized at the needed potential and the polarity can be switched at a very fast frequency (e.g., in the 10 kHz range) for a given period of time (e.g., for approximately 20 min). The two electrodes can subsequently be removed and analyzed (e.g., using a technique such as X-ray fluorescence (XRF)) to determine if any corrosion has occurred thereon. If not, the same systematic process can be iteratively repeated at lower and lower frequencies until corrosion is detected, thereby determining the minimum frequency required to limit electron transfer that causes corrosion.

Figure 5:
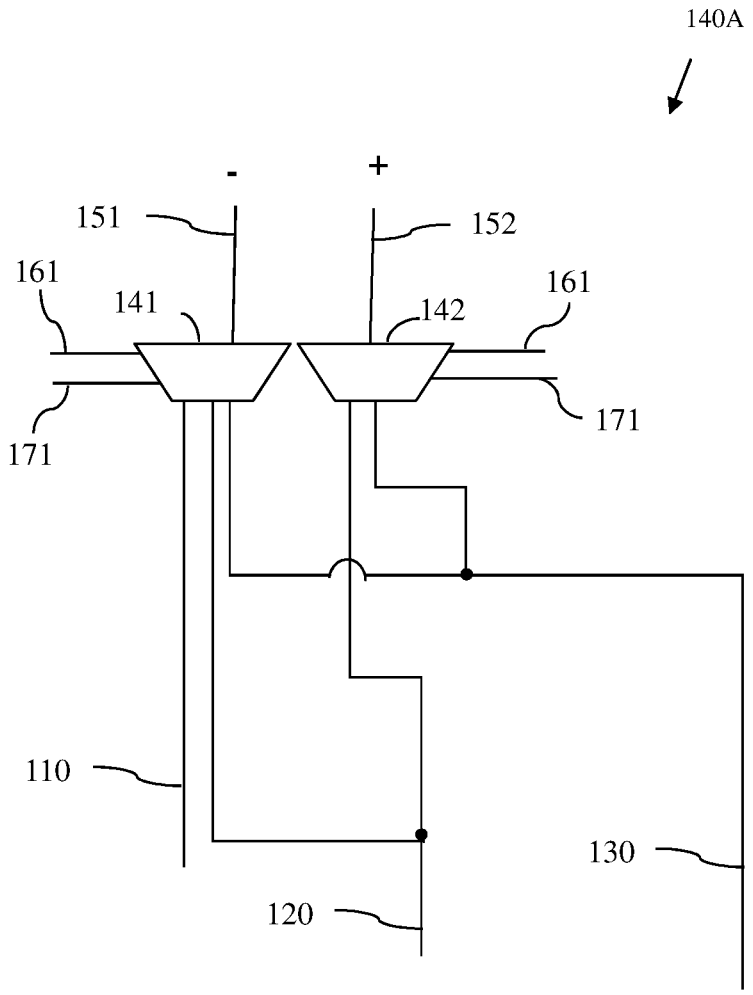
FIG. 5 is a schematic diagram illustrating an exemplary polarity-switching unit.
Figure 9:
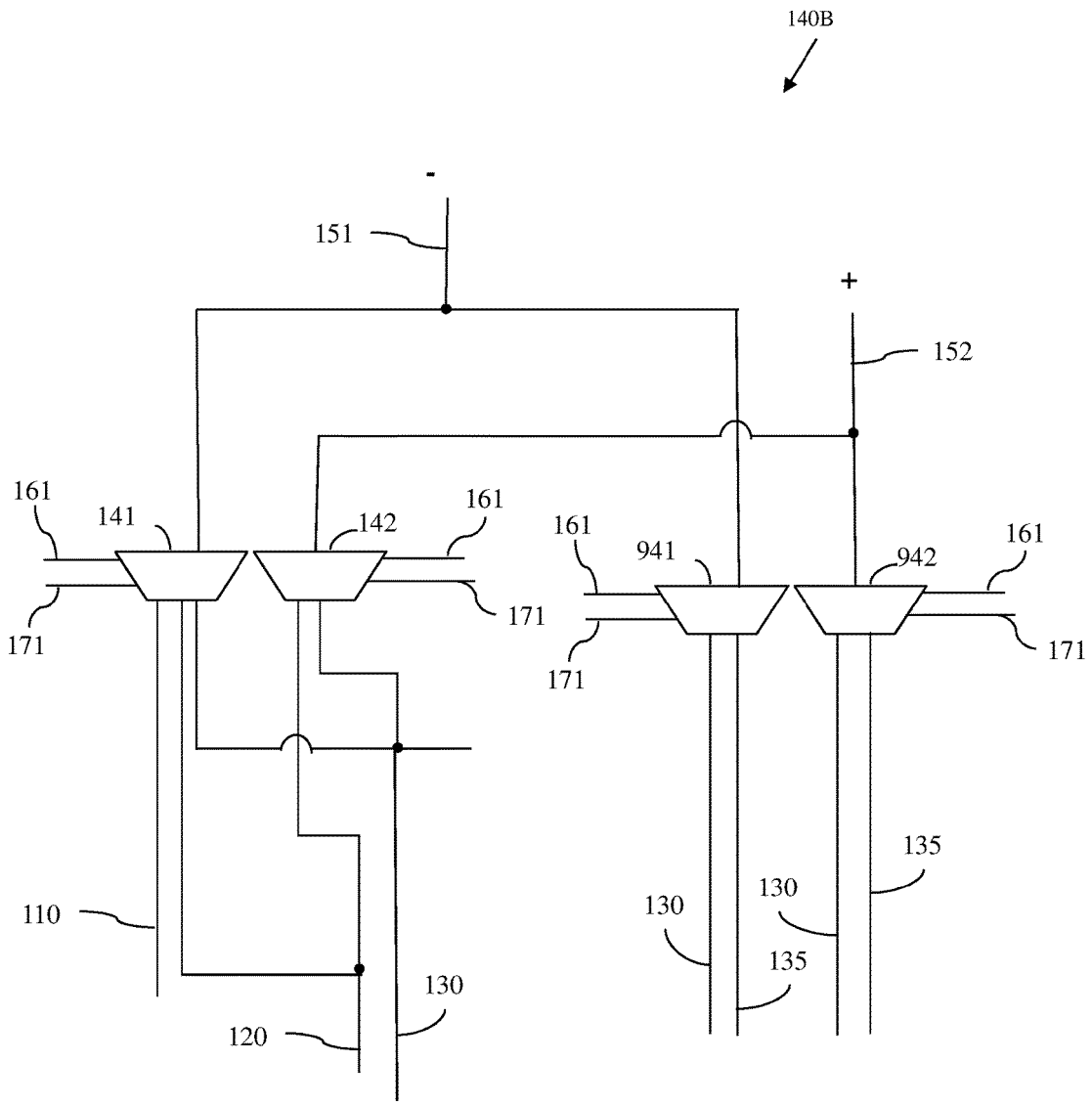
FIG. 9 illustrates another exemplary polarity-switching unit that specifically can be incorporated into the electrodeposition system of FIG. 3.

FIG. 5 is a schematic diagram illustrating an exemplary polarity-switching unit 140A that can be incorporated into the electrodeposition systems 100A and 100B of FIGS. 1 and 2, respectively. This polarity-switching unit 140A can comprise a first multiplexer 141 that is electrically connected to the negative terminal 151 of the power source 150 and that receives (i.e., that is adapted to receive, that is configured to receive, etc.) both the operating mode select signal 161 from the controller 160 and the polarity-switching signal 171 from the signal generator 170. This polarity-switching unit 140A can further comprise a second multiplexer 142 that is electrically connected to the positive terminal 152 of the power source 150 and that also receives (i.e., that is adapted to also receive, that is configured to also receive, etc.) both the operating mode select signal 161 from the controller 160 and the polarity-switching signal 171 from the signal generator 170. It should be noted that the electrodeposition system 100C of FIG. 3 can incorporate the polarity-switching unit 140A of FIG. 5 with additional switching mechanisms integrated therein (e.g., see the more complex polarity switching unit 140B, which is illustrated in FIG. 9 and which is described in greater detail below specifically with respect to the electrodeposition system 100C).

With such a configuration, the first and second multiplexers 141-142 can establish the required connections for the active plating and non-plating modes based on the operating mode select signal 161 received from the controller 160. Furthermore, with such a configuration, the regular intervals at which the opposite polarities of the second electrode 120 and third electrode 130 are switched during the non-plating mode can be established based on the frequency of the polarity-switching signal 171 received from the signal generator 170, as discussed above. When the operating mode select signal 161 has a first value that indicates the active plating mode, the first multiplexer 141 can electrically connect the negative terminal 151 of the power source 150 to the first electrode 110 and the second multiplexer 142 can electrically connect the positive terminal 152 of the power source 150 to the second electrode 120, thereby leaving the third electrode 130 unconnected to either terminal of the power source 150 (i.e., unpolarized) and establishing the constant polarity state (i.e., a constant voltage power) between the first electrode 110 and the second electrode 120. However, when the first electrode 110 has been removed from the plating solution 102 and the operating mode select signal 161 has a second value that indicates the non-plating mode, the first multiplexer 141 can alternatingly electrically connect the negative terminal 151 to the second electrode 120 and the third electrode 130 at the regular intervals and the second multiplexer 142 can alternatingly electrically connect the positive terminal 152 to the third electrode 130 and the second electrode 120 at the same regular intervals, thereby switching the constant voltage power to alternating current (AC) power. As a result, the second electrode 120 and the third electrode 130 will have opposite polarities and those opposite polarities will switch (i.e., will reverse polarities) at regular intervals such that the oscillating polarity state between the second electrode 120 and the third electrode 130 is established.

In each of the electrodeposition systems 100A, 100B, 100C described above, the second electrode 120 (i.e., which functions as the anode during the active plating mode) can be soluble, insoluble or corrosion-resistant. That is, the second electrode 120 can be a soluble electrode, an insoluble electrode or a corrosion-resistant anode. For purposes of this disclosure, a soluble electrode refers to an electrode having an outer metal surface that is exposed to the plating solution and that is soluble in the particular plating solution used. An insoluble electrode refers to an electrode having at least an outer metal surface that is exposed to the plating solution and that is insoluble in (i.e., can not be dissolved in) the particular plating solution used. A corrosion-resistant electrode refers to an electrode having at least an outer metal surface that is exposed to the plating solution, that is insoluble in the particular plating solution used (i.e., that is an insoluble electrode) and that is also resistant to corrosion by the particular plating solution used during idle times (i.e., during non-plating periods). In, for example, SnAg electrodeposition using the above-described MSA-based plating solution, a soluble electrode can refer to, for example, a tin (Sn) electrode because tin (Sn), when exposed to an MSA-based plating solution during an active plating process is soluble in that solution; an insoluble electrode can refer to, for example, a platinum (Pt) catalyst-coated titanium (Ti) electrode because Ti, when exposed to the MSA-based plating solution is insoluble in (i.e., can not be dissolved in) that MSA-based solution during active plating, but may still be subject to corrosion by the plating solution during idle times (i.e., during non-plating periods); and a corrosion-resistant electrode can refer, for example, to a graphite electrode, an Alkaline earth metal electrode (e.g., a Vanadium (V) electrode, a niobium (Nb) electrode or Tantalum (Ta) electrode) or an austenitic-type stainless steel electrode because graphite, Alkaline earth metals, such as V, Nb and Ta, as well as austenitic-type stainless steel are not only insoluble in the MSA-based plating solution during active plating, but are also resistant to corrosion by that MSA-based solution during idle times (i.e., during non-plating periods).

Furthermore, as discussed in greater detail below, depending upon the configuration of the electrodeposition system 100A, 100B, 100C, all the electrodes can be submerged in the plating solution or only the first and second electrodes can be submerged in the plating solution and the third electrode can be submerged in a different solution. Additionally, as discussed in greater detail below, depending upon the configuration of the electrodeposition system 100A, 100B, 100C, the third electrode 130 can be either a corrosion-resistant electrode or simply an insoluble electrode.

For example, referring to FIG. 1, in the electrodeposition system 100A, the first electrode 110, the second electrode 120 and the third electrode 130 can be submerged in the plating solution 102, during the active plating mode. The second electrode 120 and third electrode 130 can remain submerged in the plating solution 102, during the non-plating mode.

The second electrode 120 can comprise a soluble electrode comprising an outer metal surface that replenishes the plating solution 102 with metal ions during the active plating mode. Alternatively, the second electrode 120 can comprise an insoluble electrode or a corrosion-resistant electrode and the metal ions of the one or more metal species in the plating solution 102 can be replenished with a metal salt or a metal concentrate (which comprises the metal salt previously dissolved in the same solvent as in the plating solution) that is placed in the plating solution 102 periodically or as necessary and dissolved.

Figure 6A:
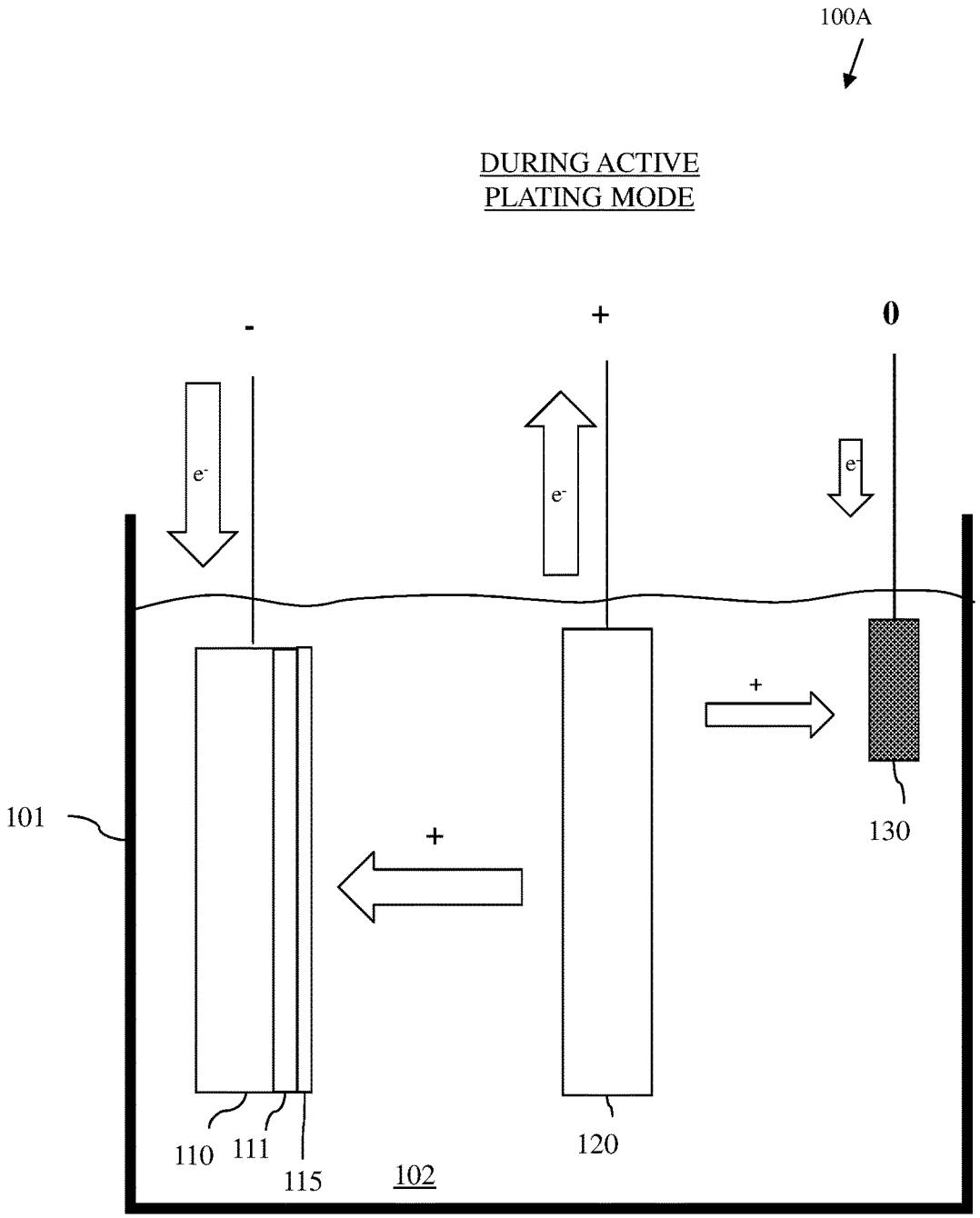
FIG. 6A is a schematic diagram illustrating in greater detail operation of the electrodeposition system of FIG. 1 in an active plating mode.

In this electrodeposition system 100A, during the active plating mode, the third electrode 130 will be exposed to the plating solution 102 and will remain uncharged, as shown in FIG. 6A. However, as a result of the potential difference between the uncharged third electrode 130 and the negatively and positively charged first and second electrodes, electron transfer could potentially occur at the surface of the third electrode 130, thereby causing degradation of the third electrode 130 and/or the plating solution 102. In order to avoid such degradation, the third electrode 130 can comprise a corrosion-resistant electrode.

Figure 6B:
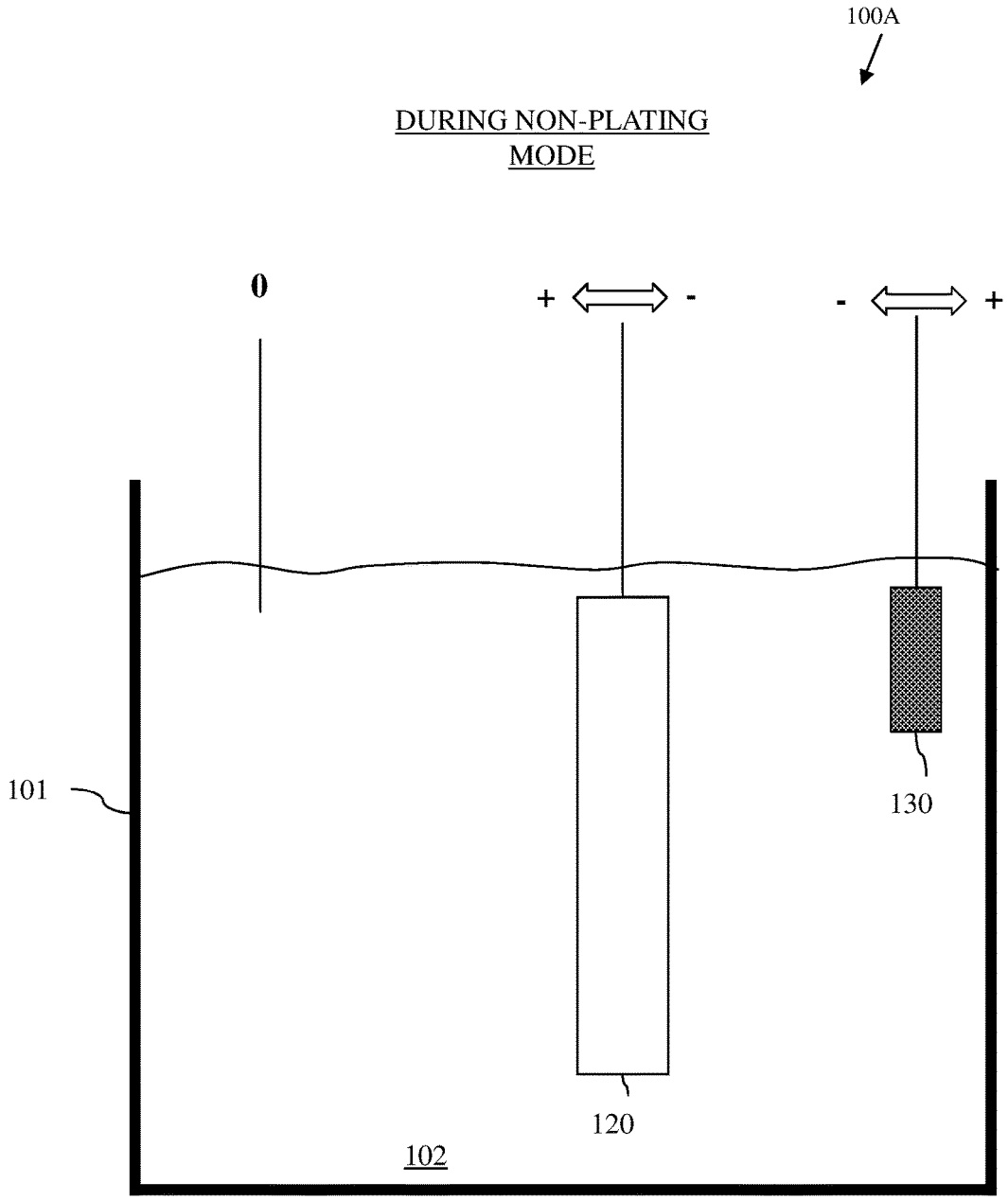
FIG. 6B is a schematic diagram illustrating operation of the electrodeposition system of FIG. 1 in a non-plating mode.

In this electrodeposition system 100A, during the non-plating mode, the oscillating polarity state means that the second electrode 120 and the third electrode 130 within the plating solution 102 have opposite polarities and the opposite polarities switch at regular, relatively fast, intervals, thereby limiting (e.g., preventing) electron transfer at the plating solution exposed surfaces of the second electrode 120 and third electrode 130 so as to limit (e.g., prevent) degradation of those electrodes 120, 130 and the second electrode 120 in particular and/or so as to limit degradation of the plating solution 102, as shown in FIG. 6B.

Typically, corrosion-resistant electrodes are more expensive than insoluble electrodes. Thus, the electrodeposition systems 100B and 100C of FIGS. 2 and 3, respectively, include additional components, which allow the third electrode 130 to be an insoluble electrode without requiring it to further be a corrosion-resistant electrode, as in the electrodeposition system 100A of FIG. 1.

Specifically, referring to FIG. 2, in the electrodeposition system 100B, the second electrode 120 can similarly comprise a soluble electrode comprising an outer metal surface that replenishes the plating solution 102 with metal ions during the active plating mode. Alternatively, the second electrode 120 can comprise an insoluble electrode or a corrosion-resistant electrode. In this case, the metal ions of the one or more metal species in the plating solution 102 can be replenished with a metal salt or a metal concentrate (which comprises the metal salt previously dissolved in the same solvent as the plating solution) that is placed in the plating solution 102 periodically or as necessary and dissolved.

This electrodeposition system 100B can also further comprise a membrane 190, which divides the container into a first compartment 104 and a second compartment 105. The membrane 190 can be permeable to some select ions and impermeable to other select ions (i.e., can be adapted to be permeable to some select ions and impermeable to other select ions, can be configured to be permeable to some select ions and impermeable to other select ions, etc.). The first compartment 104 can contain the plating solution 102, which, as discussed above, includes at least a solvent (e.g., water) and, dissolved in the solvent, a substance (e.g., an acid or base), organic additive(s) and metal ions of one or more metal species. The membrane 190 can be impermeable to the organic additive(s) and the metal ions. The first compartment 104 can further contain the first electrode 110 submerged in the plating solution 102, during the active plating mode, and the second electrode 120 submerged in the plating solution 102, during both the active plating and non-plating modes. The second compartment 105 can contain an additional solution 103 that is different from the plating solution 102 and comprises only the solvent (e.g., water) and the substance (e.g., the acid or base) dissolved in the solvent (i.e., without organics and metal ions dissolved in the solvent). The second compartment 105 can contain the third electrode 130 submerged in the additional plating solution 103 during both the active plating mode and the non-plating mode.

Figure 7A:
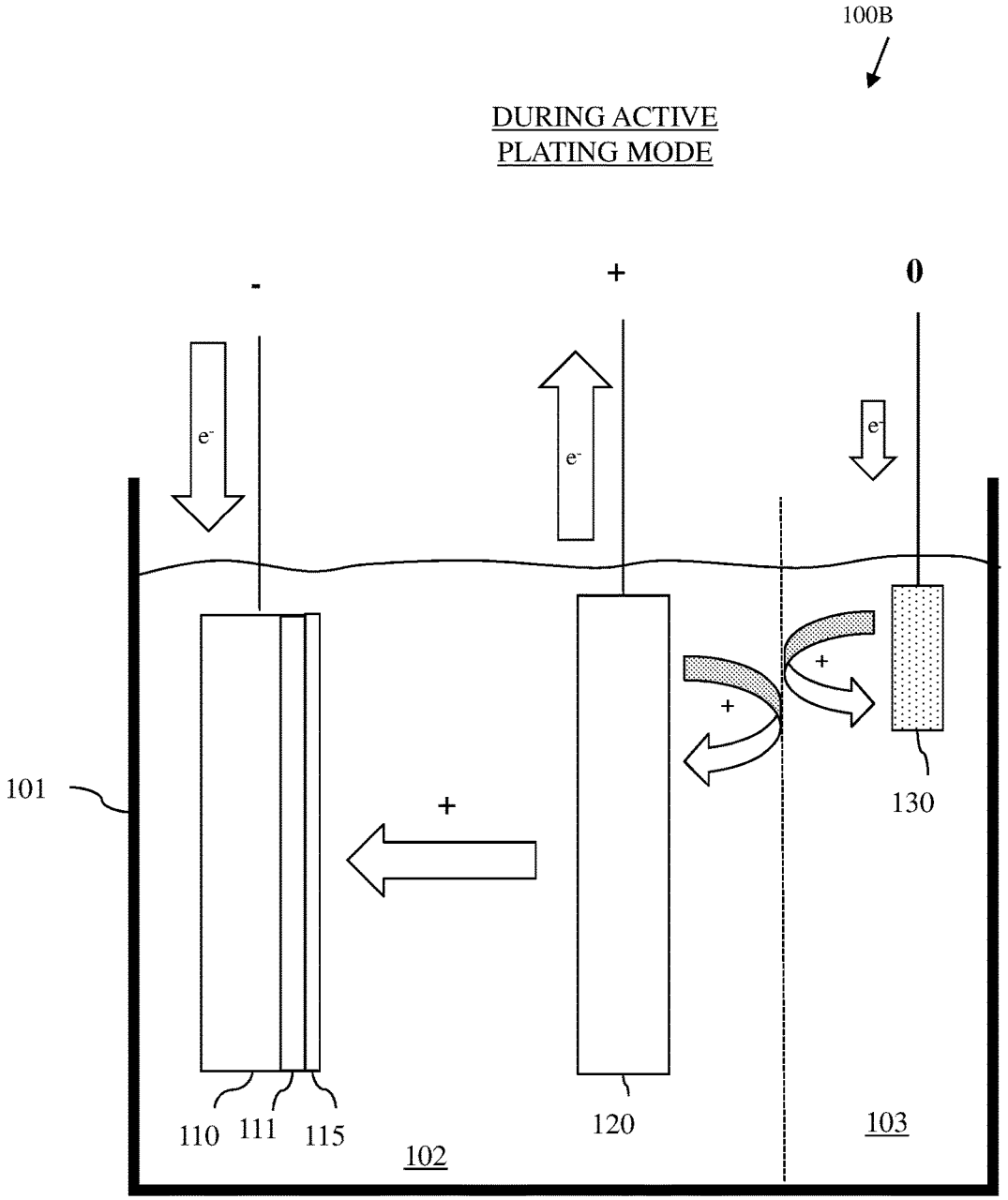
FIG. 7A is a schematic diagram illustrating in greater detail operation of the electrodeposition system of FIG. 2 in an active plating mode.

In this electrodeposition system 100B, during the active plating mode, the membrane 190 prevents ions that would otherwise cause degradation from passing between the compartments 104-105 and only exposes the third electrode 130 to the additional solution 103, which doesn't contain organic additive(s) or metal(s), as shown in FIG. 7A. Thus, the third electrode 130 and the plating solution 102 are less subject to degradation and the third electrode 130 can comprise an insoluble electrode and not necessarily a corrosion-resistant electrode.

It should be noted that in SnAg electrodeposition, for example, the first compartment 104 can contain the methyl sulfonic acid (MSA)-based plating solution 102, which, as discussed above, comprises water and, dissolved in the water, methyl sulfonic acid (MSA), organic additive(s), tin ion ($Sn^{+2}$ ions) and silver ions ($Ag^{+}$ ions). This first compartment 104 can further contain the first electrode 110 in the plating solution 102, during the active plating mode, and the second electrode 120 in the plating solution 102, during both the active plating and non-plating modes. The second compartment 105 can contain an additional solution 103 that is different from the plating solution 102 and that comprises only the MSA dissolved in water (i.e., without any organic additives or metal ions dissolved therein). In this case, the membrane 190 can be impermeable to the tin ion ($Sn^{+2}$ ions), the silver ions ($Ag^{+}$ ions) and the organic additive(s). In the active plating mode, since the membrane 190 is impermeable to the $Sn^{+2}$ ions, the $Ag^{+}$ ions and the organic additive(s) and since the third electrode 130 is only exposed to the solution 103, which doesn't contain organic additive(s) or metal(s), the third electrode 130 and the plating solution 102 are less subject to degradation. Thus, the third electrode 130 can comprise an insoluble electrode, such a platinum (Pt) catalyst-coated titanium electrode, and not necessarily a corrosion-resistant electrode.

Figure 7B:
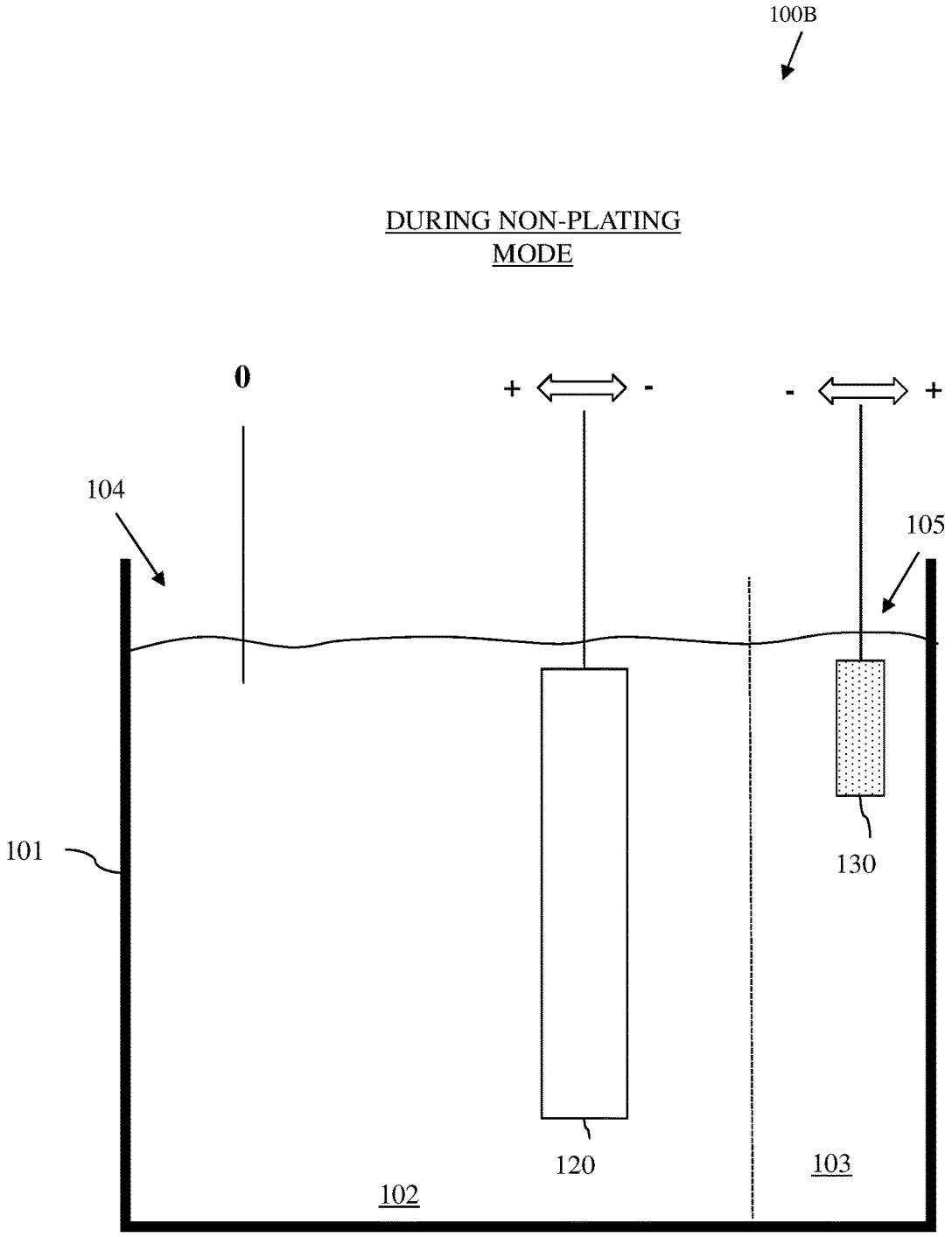
FIG. 7B is a schematic diagram illustrating operation of the electrodeposition system of FIG. 2 in a non-plating mode.

In this electrodeposition system 100B, during the non-plating mode, the oscillating polarity state means that the second electrode 120 and the third electrode 130 have opposite polarities and the opposite polarities switch at regular, relatively fast, intervals, thereby limiting (e.g., preventing) electron transfer at the plating solution exposed surface of the second electrode 120 so as to limit (e.g., prevent) degradation of the second electrode 120 and/or so as to limit degradation of the plating solution 102, as shown in FIG. 7B.

Referring to FIG. 3, in the electrodeposition system 100C, the first electrode 110, the second electrode 120, the third electrode 130 and a fourth electrode 135 (discussed below) can all be submerged within the plating solution 102, during the active plating mode. The second electrode 120, the third electrode 130 and the fourth electrode 135 can all be submerged within the plating solution 102, during the non-plating mode.

The second electrode 120 can similarly comprise a soluble electrode comprising an outer metal surface that replenishes the plating solution 102 with metal ions during the active plating mode. Alternatively, the second electrode 120 can comprise an insoluble electrode or a corrosion-resistant electrode. In this case, the metal ions of the one or more metal species in the plating solution 102 can be replenished with a metal salt or a metal concentrate (which comprises the metal salt previously dissolved in the same solvent as the plating solution) that is placed in the plating solution 102 periodically or as necessary and dissolved.

The electrodeposition system 100C can also further comprise a fourth electrode 135 in the plating solution 102 in the container 101 and additional switching mechanisms (see detailed discussion below). Specifically, the fourth electrode 135 can be electrically connected to the polarity-switching unit 140A. It can also be electrically connected to the second electrode 120 by a switch 138. The switch 138 can be electrically connected to the controller 160 and, particularly, can be controlled by the operating mode select signal 161.

Figure 8A:
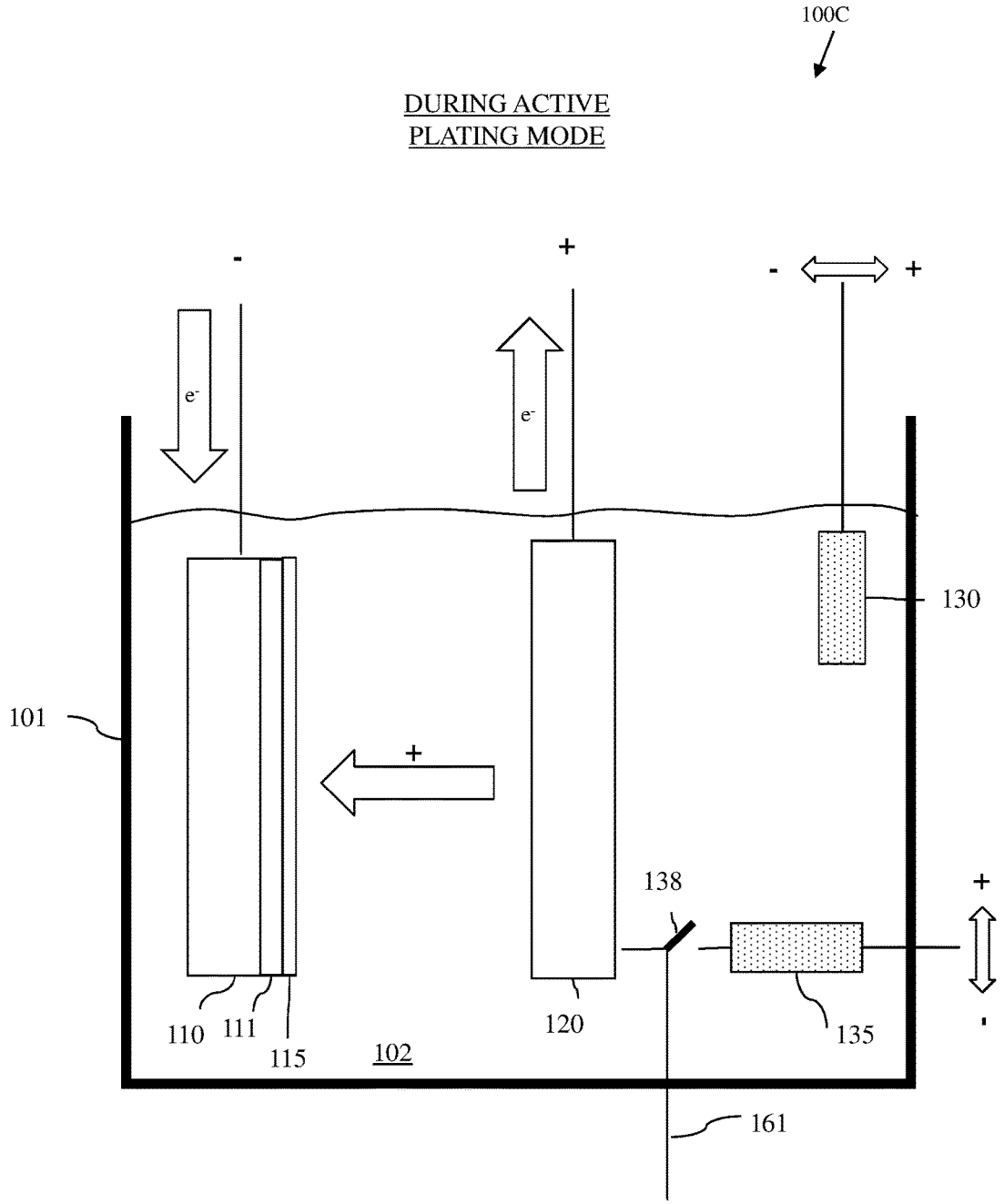
FIG. 8A is a schematic diagram illustrating in greater detail operation of the electrodeposition system of FIG. 3 in an active plating mode.

In this electrodeposition system 100C, during the active plating mode, when the operating mode select signal 161 has a first value indicating the active plating mode, the switch 138 can electrically disconnect (i.e., can be adapted to electrically disconnect, can be configured to electrically disconnect, etc.) the fourth electrode 135 from the second electrode 120, as shown in FIG. 8A. Additionally, in this active plating mode, the polarity-switching unit 140A can establish an oscillating polarity state between the third electrode 130 and the fourth electrode 135. In this oscillating polarity state, the third electrode 130 and the fourth electrode 135 will have opposite polarities and the opposite polarities will switch at regular intervals (e.g., based on the specific frequency of the polarity-switching signal 171 generated by the signal generator 170), thereby limiting (e.g., preventing) electron transfer at the surfaces of these electrodes 130, 135 and limiting (e.g., preventing) degradation of the electrodes 130, 135 and/or limiting (e.g., preventing) degradation of the plating solution 102 during active plating. Thus, the third electrode 130 and the fourth electrode 135 can comprise insoluble electrodes and not necessarily corrosion-resistant electrodes.

Figure 8B:
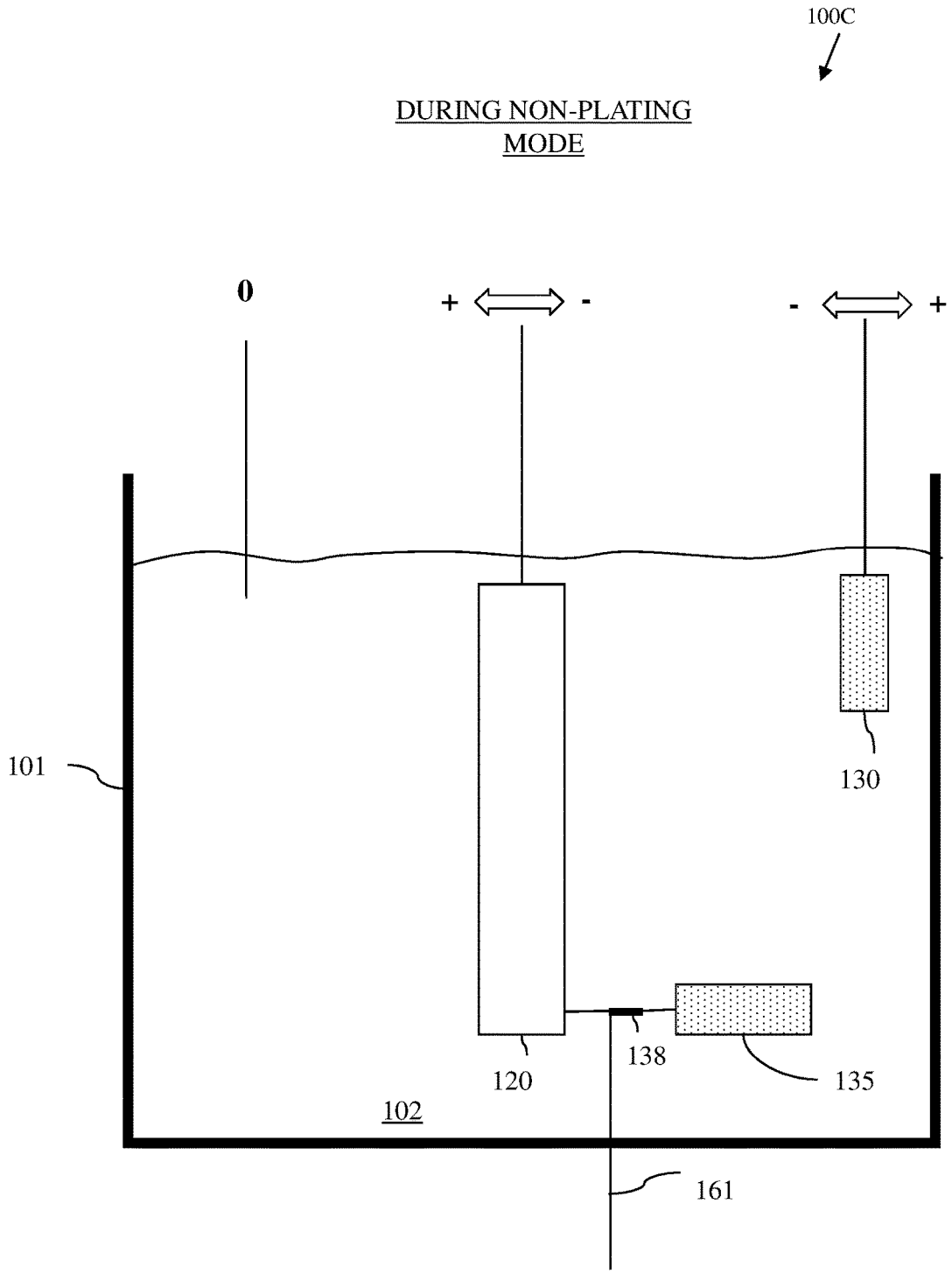
FIG. 8B is a schematic diagram illustrating operation of the electrodeposition system of FIG. 3 in a non-plating mode.

In this electrodeposition system 100C, when the operating mode select signal 161 has a second value indicating the non-plating mode, the switch 138 can electrically connect (i.e., can be adapted to electrically connect, can be configured to electrically connect, etc.) the fourth electrode 135 to the second electrode 120, as shown in FIG. 8B. Additionally, during this non-plating mode, the fourth electrode 135 will switch polarities along with the second electrode 120 (i.e., will have the same polarity as the second electrode 120) and the oscillating polarity state means that the second electrode 120 and the third electrode 130 have opposite polarities and the opposite polarities switch at regular, relatively fast, intervals, thereby limiting (e.g., preventing) electron transfer at the plating solution exposed surfaces of the second electrode 120, third electrode 130 and fourth electrode 135 so as to limit (e.g., prevent) degradation of these electrodes and/or so as to limit degradation of the plating solution 102.

FIG. 9 illustrates an exemplary polarity-switching unit 140B that can be incorporated into the electrodeposition system 100C of FIG. 3. This polarity-switching unit 140B can comprise all the same features discussed above in the polarity-switching unit 140A of FIG. 5, plus additional switching mechanisms (e.g., multiplexers) required to achieve the oscillating polarity state between the third electrode 130 and the fourth electrode 135 during the active plating mode. Specifically, this polarity-switching unit 140B can further comprise a first additional multiplexer 941 that is electrically connected to the negative terminal 151 of the power source 150 and that receives (i.e., that is adapted to receive, that is configured to receive, etc.) both the operating mode select signal 161 from the controller 160 and the polarity-switching signal 171 from the signal generator 170. This polarity-switching unit 140B can further comprise a second additional multiplexer 942 that is electrically connected to the positive terminal 152 of the power source 150 and that also receives (i.e., that is adapted to also receive, that is configured to also receive, etc.) both the operating mode select signal 161 from the controller 160 and the polarity-switching signal 171 from the signal generator 170. With such a configuration, when the operating mode select signal 161 has the first value that indicates the active plating mode, the first additional multiplexer 941 can alternatingly electrically connect the negative terminal 151 to the third electrode 130 and the fourth electrode 135 at the regular intervals and the second additional multiplexer 942 can alternatingly electrically connect the positive terminal 152 to the fourth electrode 135 and the third electrode 130 at the same regular intervals, thereby switching the constant voltage power to alternating current (AC) power. As a result, the third electrode 130 and the fourth electrode 135 will have opposite polarities and those opposite polarities will switch (i.e., will reverse polarities) at regular intervals such that the oscillating polarity state between the third electrode 130 and the fourth electrode 135 is established. Furthermore, these additional multiplexers 941-942 can only provide (i.e., can be adapted to only provide, can be configured to only provide, etc.) electrical connections between the first and second terminals 151-152 of the power source 150 and the third and fourth electrodes 130, 135 only when the operating mode select signal 161 has the first value.

Also disclosed herein are electrodeposition methods. For purposes of illustration, the electrodeposition methods are described below for use in depositing a plated layer of tin-silver (SnAg). SnAg plate is typically used as solder for controlled collapsed chip connections (i.e., C4 connections) on integrated circuit chips. However, it should be understood that these methods could, alternatively, be used to deposit any other type of metal or metal alloy plated layer. That is, these electrodeposition methods could alternatively be used to deposit a plated layer comprising one or more of a variety of different metals including, but are not limited to, tin (Sn), silver (Ag), nickel (Ni), cobalt (Co), lead (Pb) copper (Cu), palladium (Pd), gold (Au) and their various alloys.

Figure 10:
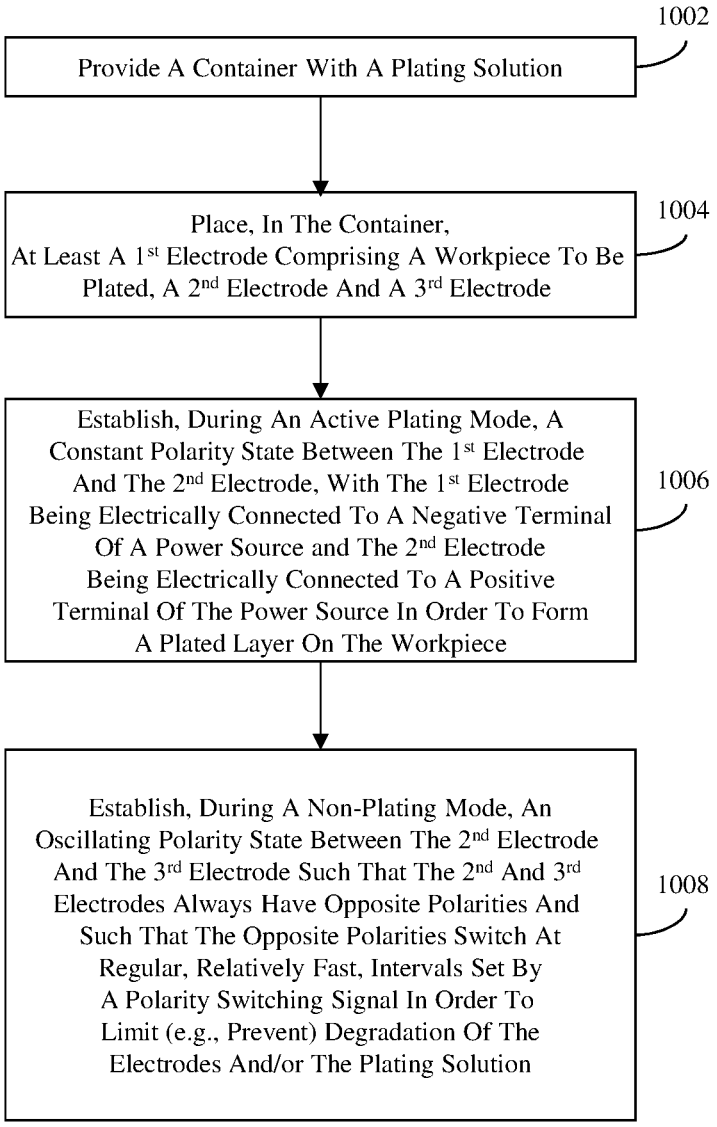
FIG. 10 is a flow diagram illustrating electrodeposition methods.

Referring to the flow diagram of FIG. 10 in combination with the electrodeposition systems 100A, 100B, 100C illustrated in FIGS. 1, 2 and 3, respectively, and described above, the methods disclosed herein can comprise providing a container 101 containing a plating solution 102 (1002). For purposes of this disclosure, a plating solution comprises at least a solvent (e.g., water) and a substance (e.g., an acid or base) that is dissolved in the solvent and that provides ionic conductivity. Optionally, a plating solution can comprise one or more organic additive(s) (also referred to herein as organics), such as complexers, charge carriers, levelers, brighteners and/or wetters, dissolved in the solvent. The plating solution can also comprise one or more metal species dissolved in the solvent. The metal specie(s) can be dissolved in the plating solution 102 from metal salt(s) or from metal concentrate(s) (which are metal salt(s) previously dissolved in the same solvent used in the plating solution) and/or from soluble anode(s) used during an active plating mode, as discussed in greater detail below. In SnAg electrodeposition, for example, this plating solution 102 can comprise a methyl sulfonic acid (MSA)-based plating solution comprising a solvent and, particularly, water and methyl sulfonic acid (MSA) that is dissolved in the water and that provides ionic conductivity. Alternatively, this plating solution 102 can comprise a phosphonate-based plating solution, pyrophosphate-based plating solution or any other suitable plating solution. The plating solution 102 can also comprise tin ions ($Sn^{2+}$ ions) and silver (Ag+ ions) dissolved in the water. The tin ions ($Sn^{2+}$ ions) can be dissolved in the water from a tin (Sn) salt or from a tin (Sn) concentrate and/or can be dissolved in the water, during active plating, from a soluble tin (Sn) anode (e.g., if such an anode is used (see detailed discussion below regarding anode composition)). The silver ions (Ag+ ions) can be dissolved in the water from a silver (Ag) salt or a silver (Ag) concentrate (which comprises Ag salt previously dissolved in water or an MSA solution).

At least three electrodes can be placed in the container 101 (1004). These electrodes can comprise a first electrode 110 removeably placed in the container 101 with and electrically connected to a workpiece 111 (i.e., an object, an article, etc.) to be plated; a second electrode 120 in the container 101; a third electrode 130 in the container 101; and, optionally, a fourth electrode 135 in the container 101 (see detailed discussion below). Depending upon the specific electrodeposition system 100A, 100B, 100C used to implement the method, either all the electrodes will be submerged within the plating solution 102 in the container 101 or, alternatively, all but the third electrode will be submerged in the plating solution 102 and the third electrode 130 will be submerged in an additional solution 103 in a second compartment within the container 101 (see detailed discussion below).

In any case, the method can further comprise establishing a constant polarity state between the first electrode 110 and the second electrode 120 in the plating solution 102 during an active plating mode (1006). Specifically, the constant polarity state can be established such that the first electrode 110 has a negative polarity (i.e., is a cathode) and the second electrode 120 has a positive polarity (i.e., is an anode), thereby allowing metal ions (e.g., $Sn^{2+}$ ions and $Ag^{+}$ ions) dissolved in the plating solution 102 to form a plated layer 115 of a metal or metal alloy (e.g., a SnAg plated layer) on the workpiece 111 (as shown in FIG. 4).

The method can also further comprise establishing an oscillating polarity state between the second electrode 120 and the third electrode 130 during a non-plating mode, when the first electrode 110 with the workpiece 111 is removed from the plating solution 102 (1008). Specifically, this oscillating polarity state can be established such that the second electrode 120, which functioned as the anode during active plating, and the third electrode 130 have opposite polarities and such that the opposite polarities switch at regular, relatively fast, intervals, thereby limiting (e.g., preventing) electron transfer at the plating solution exposed surfaces of the second electrode 120 (and, if applicable, the third electrode 130) so as to limit (e.g., prevent) degradation of those electrodes 120, 130 and the second electrode 120 in particular and/or so as to limit degradation of the plating solution 102.

To further explain this technique, it should be noted that the oscillating polarity state between the second electrode 120 and third electrode 130 takes advantage of the time required for an electrolytic double layer to establish itself on the surfaces of either of the electrodes 120 and 130. If the polarities are switched fast enough (i.e., if the current direction is switched fast enough), for a given voltage, there will not be enough time for an electrolytic double layer to form on either of the electrodes 120 and 130. By preventing formation of this electrolytic double layer, electron transfer and the typical corrosion processes are prevented.

It should also be noted that, in the active plating mode at process 1006, the third electrode 130 can remain unpolarized or, alternatively, another oscillating polarity state can be established between the third electrode 130 and a fourth electrode 135 (see more detailed discussion below).

In any case, the processes of establishing the constant polarity state between the first electrode 110 and the second electrode 120 in the active plating mode (1006) and establishing the oscillating polarity state between the second electrode 120 and the third electrode 130 in the non-plating mode (1008) can be performed by a polarity-switching unit 140. As discussed in detail above with regard to the various electrodeposition systems 100A, 100B, 100C of FIGS. 1, 2 and 3, respectively, the polarity-switching unit 140 can be electrically connected to each of the electrodes. That is, the polarity-switching unit 140 can be electrically connected to the first electrode 110, the second electrode 120, the third electrode 130 and, if present, a fourth electrode 135. The polarity-switching unit 140 can also be electrically connected to the negative terminal 151 and the positive terminal 152 of a power source 150.

It should be noted that this power source 150 can operate (i.e., can be adapted to operate, can be configured to operate, etc.) in a constant voltage mode. The potential difference measured in volts (V) between the negative terminal 151 and the positive terminal 152 can be set at specific potential difference that is predetermined to optimize plating of the specific metal specie(s) used as a plated layer 115 on the workpiece 111. Additionally, in SnAg electrodeposition, for example, the potential difference required for tin (Sn) to dissolve in the MSA-based plating solution from a soluble Sn anode (if used) and for $Sn^{2+}$ ions and Ag+ ions to plate as a SnAg plated layer 115 on a workpiece 111 is at least 0.9 volts and the optimal potential difference (e.g., to ensure uniform plating) is between 1 and 5 volts.

Using this polarity-switching unit 140, the processes of establishing the constant polarity state between the first electrode 110 and the second electrode 120 in the active plating mode (1006) and establishing the oscillating polarity state between the second electrode 120 and the third electrode 130 in the non-plating mode (1008) can comprise receiving, by the polarity-switching unit 140, an operating mode select signal 161 from a controller 160 and a polarity-switching signal from a signal generator 170.

The operating mode select signal 161 can be generated by the controller 160, based on user input. Alternatively, the operating mode select signal 161 can be generated by the controller 160 automatically based on sensor or other inputs indicating whether the first electrode 110 is within the plating solution 102 within the container 101 or has been removed from the plating solution 102 (e.g., following plating). In any case, the operating mode select signal 161 can have a first value indicating the active plating mode and a second value, which is different from the first value, indicating the non-plating mode.

The polarity-switching signal 171 can be generated by the signal generator 170 such that it has a specific frequency that defines the regular intervals at which the opposite polarities on the second electrode 120 and third electrode 130 will switch during the non-plating mode. This specific frequency can be predetermined so that the polarity-switching is fast enough to ensure that electron transfer at the surfaces of the second electrode 120 and third electrode 130 is limited (e.g., prevented) and, thereby to ensure the plating on or corrosion of those electrodes is also limited (e.g., prevented). That is, the frequency should be such that, for a given voltage, there will not be enough time for an electrolytic double layer to form on either of the electrodes 120 and 130. By preventing formation of this electrolytic double layer, electron transfer and the typical corrosion processes are prevented. This frequency will vary (e.g., from approximately 1 kHz up 1 MHz or even up to a GHz) depending upon the size of the applications and the composition of the plating solution 102, the metal specie(s) being plated, etc. In SnAg electrodeposition, for example, the required frequency to limit electron transfer at the second electrode 120 and third electrode 130 is at least 0.5 kHz and the optimal frequency (e.g., to prevent electron transfer) is between 1 kHz and 10 kHz.

It should be understood that, since the nature of the corrosion of the electrodes is dependent upon the compositions of the electrodes and of the plating solution used, the specifications for system operation during the non-plating mode to ensure that plating on or corrosion of the electrodes is limited can be determined using a systematic approach. For example, the potential needed to suppress corrosion of a given metal of an electrode in a given plating solution can be determined through the use of a Tafel plot of the given metal within the given plating solution relative to a reference electrode. The required frequency needed to limit electron transfer can further be determined by using two electrodes of the same given metal. The two electrodes can be polarized at the needed potential and the polarity can be switched at a very fast frequency (e.g., in the 10 kHz range) for a given period of time (e.g., for approximately 20 min). The two electrodes can subsequently be removed and analyzed (e.g., using a technique such as X-ray fluorescence (XRF)) to determine if any corrosion has occurred thereon. If not, the same systematic process can be iteratively repeated at lower and lower frequencies until corrosion is detected, thereby determining the minimum frequency required to limit electron transfer that causes corrosion.

As discussed in detail above with regard to the various electrodeposition systems 100A, 100B, 100C, FIG. 5 is a schematic diagram illustrating an exemplary polarity-switching unit 140A that can be incorporated into the electrodeposition systems 100A and 100B of FIGS. 1 and 2. FIG. 9 is another exemplary polarity-switching unit 140B that includes all of the features of the polarity-switching unit 140A, plus additional switching mechanisms, as discussed in detail below, that allow it to be can be incorporated in the electrodeposition system 100C of FIG. 3.

It should be noted that in the electrodeposition methods disclosed herein, the second electrode 120 (i.e., which functions as the anode during the active plating mode at process 1006) can be soluble, insoluble or corrosion-resistant. That is, the second electrode 120 can be a soluble electrode, an insoluble electrode or a corrosion-resistant anode. For purposes of this disclosure, a soluble electrode refers to an electrode having an outer metal surface that is exposed to the plating solution and that is soluble in the particular plating solution used. An insoluble electrode refers to an electrode having at least an outer metal surface that is exposed to the plating solution and that is insoluble in (i.e., can not be dissolved in) the particular plating solution used. A corrosion-resistant electrode refers to an electrode having at least an outer metal surface that is exposed to the plating solution, that is insoluble in the particular plating solution used (i.e., that is an insoluble electrode) and that is also resistant to corrosion by the particular plating solution used. In, for example, SnAg electrodeposition using the above-described MSA-based plating solution, a soluble electrode can refer to, for example, a tin (Sn) electrode because tin (Sn), when exposed to an MSA-based plating solution during an active plating process is soluble in that solution; an insoluble electrode can refer to, for example, a platinum (Pt) catalyst-coated titanium (Ti) electrode because Ti, when exposed to the MSA-based plating solution is insoluble in (i.e., can not be dissolved in) that MSA-based solution during active plating, but may still be subject to corrosion by the plating solution during idle times (i.e., during non-plating periods); and a corrosion-resistant electrode can refer, for example, to a graphite electrode, an Alkaline earth metal electrode (e.g., a Vanadium (V) electrode, a niobium (Nb) electrode or Tantalum (Ta) electrode) or an austenitic-type stainless steel electrode because graphite, Alkaline earth metals, such as V, Nb and Ta, as well as austenitic-type stainless steel are not only insoluble in the MSA-based plating solution during active plating, but also resistant to corrosion by that MSA-based plating solution during idle times (i.e., during non-plating periods).

Furthermore, as discussed in greater detail below, depending upon the configuration of the electrodeposition system 100A, 100B, 100C used to perform these methods all the electrodes can be submerged in the plating solution during the active plating mode or only the first and second electrodes can be submerged in the plating solution during the active plating mode and the third electrode can be submerged in an additional solution. Additionally, as discussed in greater detail below, depending upon the configuration of the electrodeposition system 100A, 100B, 100C used to perform these methods the third electrode 130 can be either a corrosion-resistant electrode or simply an insoluble electrode.

For example, in one electrodeposition method performed using the electrodeposition system 100A of FIG. 1, all three electrodes 110, 120, 130 can be submerged in the plating solution during the active plating mode and the second electrode 120 and third electrode 130 can remain within the plating solution 102 during the non-plating mode.

The second electrode 120 can comprise a soluble electrode comprising an outer metal surface that replenishes the plating solution 102 with metal ions during the active plating mode. Alternatively, the second electrode 120 can comprise an insoluble electrode or a corrosion-resistant electrode and the metal ions of the one or more metal species in the plating solution 102 can be replenished with a metal salt or a metal concentration (which comprises a metal salt previously dissolved in the same solvent as used in the plating solution) that is placed in the plating solution 102 periodically or as necessary and dissolved.

In this electrodeposition method, during the active plating mode at process 1006, the third electrode 130 will be exposed to the plating solution 102 and will remain uncharged, see FIG. 6A. However, as a result of the potential difference between the uncharged third electrode 130 and the negatively and positively charged first and second electrodes, electron transfer could potentially occur at the surface of the third electrode 130, thereby causing degradation of the third electrode 130 and/or the plating solution 102. In order to avoid such degradation at process 1006, the third electrode 130 can comprise a corrosion-resistant electrode. Furthermore, in this electrodeposition method, during the non-plating mode at process 1008, the oscillating polarity state means that the second electrode 120 and the third electrode 130 in the plating solution 102 have opposite polarities and the opposite polarities switch at regular, relatively fast, intervals, thereby limiting (e.g., preventing) electron transfer at the plating solution exposed surfaces of the second electrode 120 and third electrode 130 so as to limit (e.g., prevent) degradation of those electrodes 120, 130 and the second electrode 120 in particular and/or so as to limit degradation of the plating solution 102, as shown in FIG. 6B.

Typically, corrosion-resistant electrodes are more expensive than insoluble electrodes. Thus, additional electrodeposition methods performed using the electrodeposition systems 100B and 100C of FIGS. 2 and 3, allow the third electrode 130 to be an insoluble electrode without requiring it to further be a corrosion-resistant electrode.

Specifically, in an electrodeposition method performed using the electrodeposition system 100B of FIG. 2, the second electrode 120 can similarly comprise a soluble electrode comprising an outer metal surface that replenishes the plating solution 102 with metal ions during the active plating mode. Alternatively, the second electrode 120 can comprise an insoluble electrode or a corrosion-resistant electrode. In this case, the metal ions of the one or more metal species in the plating solution 102 can be replenished with a metal salt or a metal concentration (which comprises the metal salt previously dissolved in the same solvent as used in the plating solution) that is placed in the plating solution 102 periodically or as necessary and dissolved.

Additionally, the electrodeposition system 100B can further comprise a membrane 190 that divides the container 101 into a first compartment 104 and a second compartment 105. The membrane 190 can be permeable to only some select ions and impermeable to other select ions. The first compartment 104 can contain the plating solution 102, which, as discussed above, includes at least a solvent (e.g., water) and, dissolved in the solvent, a substance (e.g., an acid or base), organic additive(s) and metal ions of one or more metal species. The membrane 190 can be impermeable to the organic additive(s) and the metal ions. The first compartment 104 can further contain the first electrode 110 submerged in the plating solution 102, during the active plating mode at process 1006, and the second electrode 120 submerged in the plating solution 102, during both the active plating and non-plating modes at process 1006-1008. The second compartment 105 can contain an additional solution 103 that is different from the plating solution 102 and that comprises only the solvent with the substance (e.g., the acid or base) dissolved therein (i.e., without organics and metal ions dissolved therein). The second compartment 105 can contain the third electrode 130 submerged in the additional solution 103 during both the active plating mode and the non-plating mode.

In this electrodeposition method, during the active plating mode at process 1006, the membrane 190 prevents ions that would cause degradation from passing between the compartments 104-105 and only exposes the third electrode 130 to the solution 103, which doesn't contain organic additive(s) or metal(s). Thus, the third electrode 130 and the plating solution 102 are less subject to degradation and can comprise an insoluble electrode and not necessarily a corrosion-resistant electrode. It should be noted that in SnAg electrodeposition, for example, the first compartment 104 can contain the methyl sulfonic acid (MSA)-based plating solution 102, which, as discussed above, includes at least water and, dissolved in the water, methyl sulfonic acid (MSA), organic additive(s), tin ion ($Sn^{+2}$ ions), and silver ions ($Ag^{+}$ ions). In this case, the membrane 190 can be impermeable to the tin ion ($Sn^{+2}$ ions), the silver ions ($Ag^{+}$ ions) and the organic additive(s). The first compartment 104 can further contain the first electrode 110 in the plating solution 102, during the active plating mode at process 1006, and the second electrode 120 in the plating solution 102, during both the active plating and non-plating modes at process 1006-1008. The second compartment 105 can contain an additional solution 103 that is different from the plating solution 102 and that comprises only the MSA dissolved in water (i.e., without any organic additives or metal ions dissolved therein). In the active plating mode, since the membrane 190 is impermeable to the $Sn^{+2}$ ions, the $Ag^{+}$ ions and the organic additive(s) and since the third electrode 130 is only exposed to the solution 103, which doesn't contain organic additive(s) or metal(s), the third electrode 130 and the plating solution 102 are less subject to degradation. Thus, the third electrode 130 can comprise an insoluble electrode, such a platinum (Pt) catalyst-coated titanium electrode, and not necessarily a corrosion-resistant electrode. Furthermore, in this electrodeposition method, during the non-plating mode at process 1008, the oscillating polarity state means that the second electrode 120 and the third electrode 130 have opposite polarities and the opposite polarities switch at regular, relatively fast, intervals, thereby limiting (e.g., preventing) electron transfer at the plating solution exposed surface of the second electrode 120 so as to limit (e.g., prevent) degradation of the second electrode 120 and/or so as to limit degradation of the plating solution 102, as shown in FIG. 7B.

In yet another electrodeposition method performed using the electrodeposition system 100C of FIG. 3, the first electrode 110, the second electrode 120, the third electrode 130 and a fourth electrode (discussed below) can be submerged within the plating solution 102, during the active plating mode. The second electrode 120, the third electrode 130 and the fourth electrode can remain submerged within the plating solution 102, during the non-plating mode.

In this case, the second electrode 120 can similarly comprise a soluble electrode comprising an outer metal surface that replenishes the plating solution 102 with metal ions during the active plating mode. Alternatively, the second electrode 120 can comprise an insoluble electrode or a corrosion-resistant electrode. In this case, the metal ions of the one or more metal species in the plating solution 102 can be replenished with a metal salt or a metal concentration (which comprises the metal salt previously dissolved in the same solvent as used in the plating solution) that is placed in the plating solution 102 periodically or as necessary and dissolved.

Additionally, the electrodeposition system 100C can further comprise the fourth electrode 135 and additional switching mechanisms (see detailed discussion below). Specifically, this fourth electrode 135 can be electrically connected to the polarity-switching unit 140. It can also be electrically connected to the second electrode 120 by a switch 138. The switch 138 can be electrically connected to the controller 160 and, particularly, can be controlled by the operating mode select signal 161.

In this electrodeposition method, during the active plating mode at process 1006, when the operating mode select signal 161 has a first value indicating the active plating mode, the switch 138 can electrically disconnect the fourth electrode 135 from the second electrode 120, as shown in FIG. 8A. Additionally, in this active plating mode at process 1006, the polarity-switching unit 140 can establish an oscillating polarity state between the third electrode 130 and the fourth electrode 135. In this oscillating polarity state, the third electrode 130 and the fourth electrode 135 will have opposite polarities and the opposite polarities will switch at regular intervals (e.g., based on the specific frequency of the polarity-switching signal 171 generated by the signal generator 170), thereby limiting (e.g., preventing) electron transfer at the surfaces of these electrodes 130, 135 and limiting (e.g., preventing) degradation of the electrodes 130, 135 and/or limiting (e.g., preventing) degradation of the plating solution 102 during active plating. Thus, the third electrode 130 and the fourth electrode 135 can comprise insoluble electrodes and, not necessarily corrosion-resistant electrodes.

In this electrodeposition method, during the non-plating mode at process 1008, when the operating mode select signal 161 has a second value indicating the non-plating mode, the switch 138 can electrically connect (i.e., can be adapted to electrically connect, can be configured to electrically connect, etc.) the fourth electrode 135 to the second electrode 120, as shown in FIG. 8B. Additionally, during this non-plating mode at process 1008, the fourth electrode 135 will switch polarities along with the second electrode 120 (i.e., will have the same polarity as the second electrode 120) and the oscillating polarity state means that the second electrode 120 and the third electrode 130 have opposite polarities and the opposite polarities switch at regular, relatively fast, intervals, thereby limiting (e.g., preventing) electron transfer at the plating solution exposed surfaces of the second electrode 120, third electrode 130 and fourth electrode 135 so as to limit (e.g., prevent) degradation of these electrodes and/or so as to limit degradation of the plating solution 102.

FIG. 9 illustrates an exemplary polarity-switching unit 140B that can be incorporated into the electrodeposition system 100C of FIG. 3. This polarity-switching unit 140B can comprise all the same features discussed above in the polarity-switching unit 140A of FIG. 5, plus additional switching mechanisms (e.g., multiplexers) required to achieve the oscillating polarity state between the third electrode 130 and the fourth electrode 135 during the active plating mode. Specifically, this polarity-switching unit 140B can further comprise a first additional multiplexer 941 that is electrically connected to the negative terminal 151 of the power source 150 and that receives (i.e., that is adapted to receive, that is configured to receive, etc.) both the operating mode select signal 161 from the controller 160 and the polarity-switching signal 171 from the signal generator 170. This polarity-switching unit 140B can further comprise a second additional multiplexer 942 that is electrically connected to the positive terminal 152 of the power source 150 and that also receives (i.e., that is adapted to also receive, that is configured to also receive, etc.) both the operating mode select signal 161 from the controller 160 and the polarity-switching signal 171 from the signal generator 170. With such a configuration, when the operating mode select signal 161 has the first value that indicates the active plating mode, the first additional multiplexer 941 can alternatingly electrically connect the negative terminal 151 to the third electrode 130 and the fourth electrode 135 at the regular intervals and the second additional multiplexer 942 can alternatingly electrically connect the positive terminal 152 to the fourth electrode 135 and the third electrode 130 at the same regular intervals, thereby switching the constant voltage power to alternating current (AC) power. As a result, the third electrode 130 and the fourth electrode 135 will have opposite polarities and those opposite polarities will switch (i.e., will reverse polarities) at regular intervals such that the oscillating polarity state between the third electrode 130 and the fourth electrode 135 is established. Furthermore, these additional multiplexers 941-942 can only provide (i.e., can be adapted to only provide, can be configured to only provide, etc.) electrical connections between the first and second terminals 151-152 of the power source 150 and the third and fourth electrodes 130, 135 only when the operating mode select signal 161 has the first value.

Also disclosed herein is a computer program product. The computer program product can comprise a computer readable storage medium having program instructions embodied therewith (i.e., stored thereon). The program instructions can be executable by a processor (e.g., by a processor of the controller 160 in the electrodeposition systems 100A, 100B, 100C discussed above) in order to cause the processor to carry out aspects of the present invention and, particularly, to cause the above-described electrodeposition systems to perform the above-described electrodeposition methods.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a wave-guide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Figure 11:
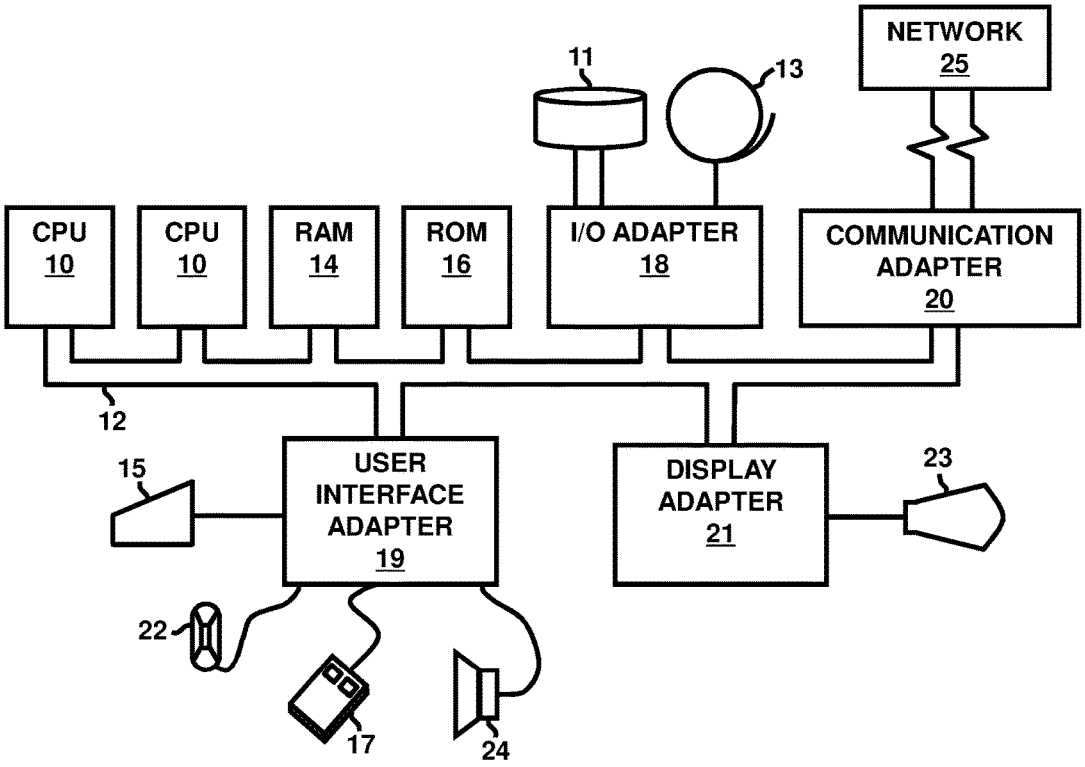
FIG. 11 is an exemplary hardware environment that can be used to implement the disclosed electrodeposition systems and methods.

FIG. 11 depicts a representative hardware environment that can be used to implement the above-described systems, methods and computer program products. This schematic drawing illustrates a hardware configuration of an information handling/computer system in accordance with the embodiments herein. The system comprises at least one processor or central processing unit (CPU) 10. The CPUs 10 are interconnected via a system bus 12 to various devices such as a random access memory (RAM) 14, read-only memory (ROM) 16, and an input/output (I/O) adapter 18. The I/O adapter 18 can connect to peripheral devices, such as disk units 11 and tape drives 13, or other program storage devices that are readable by the system. The system can read the inventive instructions on the program storage devices and follow these instructions to execute the methodology of the embodiments herein. The system further includes a user interface adapter 19 that connects a keyboard 15, mouse 17, speaker 24, microphone 22, and/or other user interface devices such as a touch screen device (not shown) to the bus 12 to gather user input. Additionally, a communication adapter 20 connects the bus 12 to a data processing network 25, and a display adapter 21 connects the bus 12 to a display device 23 which may be embodied as an output device such as a monitor, printer, or transmitter, for example.

It should be understood that the terminology used herein is for the purpose of describing the disclosed [systems, methods and computer program products] and is not intended to be limiting. For example, as used herein, the singular forms "a", "an" and "the" are intended to include the plural forms as well, unless the context clearly indicates otherwise. Additionally, as used herein, the terms "comprises" "comprising", "includes" and/or "including" specify the presence of stated features, integers, steps, operations, elements, and/or components, but do not preclude the presence or addition of one or more other features, integers, steps, operations, elements, components, and/or groups thereof. Furthermore, as used herein, terms such as "right", "left", "vertical", "horizontal", "top", "bottom", "upper", "lower", "under", "below", "underlying", "over", "overlying", "parallel", "perpendicular", etc., are intended to describe relative locations as they are oriented and illustrated in the drawings (unless otherwise indicated) and terms such as "touching", "on", "in direct contact", "abutting", "directly adjacent to", etc., are intended to indicate that at least one element physically contacts another element (without other elements separating the described elements). The corresponding structures, materials, acts, and equivalents of all means or step plus function elements in the claims below are intended to include any structure, material, or act for performing the function in combination with other claimed elements as specifically claimed.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Therefore, disclosed above are electrodeposition systems and methods that minimize anode and/or plating solution degradation during idle periods (i.e., non-plating periods). Specifically, in the electrodeposition systems and methods disclosed herein at least three electrodes are placed in container containing a plating solution. These electrodes are each electrically connected to a polarity-switching unit and include at least a first electrode, a second electrode and a third electrode. The polarity-switching unit establishes a constant polarity state between the first electrode and the second electrode in the plating solution during an active plating mode. In this constant polarity state, the first electrode has a negative polarity and the second electrode has a positive polarity, thereby allowing a plated layer to form on a workpiece at the first electrode. The polarity-switching unit further establishes an oscillating polarity state between the second electrode and the third electrode during a non-plating mode (i.e., when the first electrode with the workpiece is removed from the plating solution). In this oscillating polarity state, the second electrode and the third electrode have opposite polarities that switch at regular intervals, thereby limiting electron transfer at the surface of the second electrode and limiting degradation of the second electrode and/or the plating solution.

What is claimed is:

1. An electrodeposition method comprising:

providing a container containing a plating solution and placing, in said container, three electrodes comprising:

a first electrode removeably placed in said plating solution;

a second electrode in said plating solution; and, a third electrode;

establishing a constant polarity state between said first electrode and said second electrode in said plating solution during an active plating mode such that said first electrode has a negative polarity and said second electrode has a positive polarity; and establishing an oscillating polarity state between said second electrode and said third electrode during a non-plating mode such that said second electrode and said third electrode have opposite polarities and such that said opposite polarities switch at regular intervals.

2. The electrodeposition method of claim 1, said third electrode being in said plating solution and being a corrosion-resistant electrode.

3. The electrodeposition method of claim 1, said plating solution comprising at least a solvent and, dissolved in said solvent, a substance comprising one of an acid and a base, said plating solution further comprising organic additives dissolved in said solvent, said container further being divided into a first compartment and a second compartment by a membrane, said first compartment containing said plating solution, said second compartment containing an additional solution and said third electrode in said additional solution, said additional solution comprising only said solvent and said substance dissolved in said solvent, said second electrode comprising any one of a soluble electrode and an insoluble electrode, and said third electrode comprising an additional insoluble electrode.

4. The electrodeposition method of claim 1, said second electrode comprising any one of a soluble electrode and an insoluble electrode, said third electrode and a fourth electrode being in said plating solution in said container and comprising insoluble electrodes and said method further comprising:

electrically connecting said fourth electrode to said second electrode, during said non-plating mode; and, electrically disconnecting said fourth electrode from said second electrode and further establishing another oscillating polarity state between said fourth electrode and said third electrode, during said active plating mode.

5. The electrodeposition method of claim 1, said establishing of said constant polarity state and said establishing of said oscillating polarity state being performed by a polarity-switching unit electrically connected to said first electrode, said second electrode and said third electrode, and further electrically connected to a negative terminal and a positive terminal of a power source and comprising:

receiving, by said polarity-switching unit, an operating mode select signal from a controller and a polarity-switching signal;

when said operating mode select signal indicates said active plating mode, electrically connecting said negative terminal to said first electrode and electrically connecting said positive terminal to said second electrode such that said constant polarity state between said first electrode and said second electrode is established; and when said operating mode select signal indicates said non-plating mode, alternatingly electrically connecting said negative terminal to said second electrode and said third electrode at said regular intervals and alternatingly electrically connecting said positive terminal to said third electrode and said second electrode at said regular intervals such that said second electrode and said third electrode have said opposite polarities and such that said oscillating polarity state between said second electrode and said third electrode is established, said polarity-switching signal having a frequency that defines said regular intervals.

6. The electrodeposition method of claim 5, said frequency being predetermined to limit transfer of electrons at a surface of said second electrode.

7. The electrodeposition method of claim 1, said second electrode being any one of a tin (Sn) electrode and a platinum (Pt) catalyst-coated titanium (Ti) electrode.

8. An electrodeposition method comprising:

providing a container containing a plating solution and placing, in said container, three electrodes comprising:

a first electrode removeably placed in said plating solution;

a second electrode in said plating solution; and, a third electrode, wherein a polarity-switching unit is electrically connected to said first electrode, said second electrode and said third electrode, and wherein said polarity-switching unit comprises:

a first multiplexer that is electrically connected to a negative terminal of a power source and that receives both an operating mode select signal from a controller and a polarity-switching signal from a signal generator, the polarity-switching signal having a frequency that defines regular intervals; and a second multiplexer that is electrically connected to a positive terminal of the power source and that receives both said operating mode select signal from said controller and said polarity-switching signal from said signal generator;

establishing, by said polarity-switching unit, a constant polarity state between said first electrode and said second electrode in said plating solution when said operating mode select signal indicates an active plating mode, wherein, during said constant polarity state, said first multiplexer electrically connects said negative terminal to said first electrode such that said first electrode maintains a negative polarity and said second multiplexer electrically connects said positive terminal to said second electrode such that said second electrode maintains a positive polarity, and establishing, by said polarity-switching unit, an oscillating polarity state between said second electrode and said third electrode when said operating mode select signal indicates a non-plating mode, wherein, during said oscillating polarity state, said first multiplexer alternatingly electrically connects said negative terminal to said second electrode and said third electrode at said regular intervals and said second multiplexer alternatingly electrically connecting said positive terminal to said third electrode and said second electrode at said regular intervals such that said second electrode and said third electrode maintain opposite polarities.

9. The electrodeposition method of claim 8, said third electrode being in said plating solution and being a corrosion-resistant electrode.

10. The electrodeposition method of claim 8, said second electrode being any one of a soluble electrode and an insoluble electrode.

11. The electrodeposition method of claim 8, said plating solution comprising a solvent and, dissolved in said solvent, at least a substance comprising one of an acid and a base, said plating solution further comprising organic additives dissolved in said solvent, said container being divided into a first compartment and a second compartment by a membrane, said first compartment containing said plating solution, said second compartment containing an additional solution and said third electrode in said additional solution, said additional solution being different from said plating solution and comprising only said solvent and said substance dissolved in said solvent, and said third electrode comprising an insoluble electrode.

12. The electrodeposition method of claim 8, said third electrode and a fourth electrode being in said plating solution, said third electrode and said fourth electrode comprising insoluble electrodes, and said electrodeposition method further comprising:

electrically disconnecting said fourth electrode from said second electrode during said active plating mode;

electrically connecting said fourth electrode to said second electrode during said non-plating mode; and establishing, by said polarity-switching unit, another oscillating polarity state between said fourth electrode and said third electrode during said plating mode.

13. The electrodeposition method of claim 8, said frequency being predetermined to limit transfer of electrons at a surface of said second electrode.

14. The electrodeposition method of claim 8, said second electrode being any one of a tin (Sn) electrode and a platinum (Pt) catalyst-coated titanium (Ti) electrode.

15. An electrodeposition method comprising:

providing a container containing a plating solution and placing, in said container, three electrodes comprising:

a first electrode removeably placed in said plating solution;

a second electrode in said plating solution;

a third electrode in said plating solution; and a fourth electrode in said plating solution, wherein said third electrode and said fourth electrode comprise insoluble electrodes, wherein a polarity-switching unit is electrically connected to said first electrode, said second electrode, said third electrode, and said fourth electrode, and wherein a switch is connected to the fourth electrode and the second electrode;

receiving, by said polarity-switching unit, a polarity-switching signal from a signal generator and an operating mode select signal from a controller, said operating mode select signal indicating one of an active plating mode and a non-plating mode and said polarity-switching signal having a frequency;

when said operating mode select signal indicates said active plating mode, establishing, by said polarity-switching unit, a constant polarity state between said first electrode and said second electrode in said plating solution such that said first electrode has a negative polarity and said second electrode has a positive polarity;

when said operating mode select signal indicates said non-plating mode, establishing, by said polarity-switching unit, an oscillating polarity state between said second electrode and said third electrode such that said second electrode and said third electrode have opposite polarities and such that said opposite polarities switch at regular intervals defined by said frequency;

when said operating mode select signal indicates said active plating mode, further disconnecting, by said switch, said fourth electrode from said second electrode and establishing, by said polarity-switching unit, another oscillating polarity state between said fourth electrode and said third electrode; and when said operating mode select signal indicates said non-plating mode, further electrically connecting, by said switch, said fourth electrode to said second electrode.

16. The electrodeposition method of claim 15, said second electrode being any one of a soluble electrode and an insoluble electrode.

17. The electrodeposition method of claim 15, said polarity-switching unit comprising:

a first multiplexer electrically connected to a negative terminal of a power source and receiving both said operating mode select signal and said polarity-switching signal; and a second multiplexer electrically connected to a positive terminal of said power source and receiving said operating mode select signal and said polarity-switching signal, when said operating mode select signal indicates said active plating mode, said first multiplexer electrically connecting said negative terminal to said first electrode and said second multiplexer electrically connecting said positive terminal to said second electrode such that said constant polarity state between said first electrode and said second electrode is established, and when said operating mode select signal indicates said non-plating mode, said first multiplexer alternatingly electrically connecting said negative terminal to said second electrode and said third electrode at said regular intervals and said second multiplexer alternatingly electrically connecting said positive terminal to said third electrode and said second electrode at said regular intervals such that said second electrode and said third electrode have said opposite polarities and such that said oscillating polarity state between said second electrode and said third electrode is established.

18. The electrodeposition method of claim 15, said frequency being predetermined to limit transfer of electrons at a surface of said second electrode.

19. The electrodeposition method of claim 15, said second electrode being any one of a tin (Sn) electrode and a platinum (Pt) catalyst-coated titanium (Ti) electrode.

* * * * *